US010129937B1

(12) United States Patent
Lin et al.

(10) Patent No.: US 10,129,937 B1
(45) Date of Patent: Nov. 13, 2018

(54) CONTROLLING FLICKER CAUSED BY MULTIPLE LIGHT SOURCES

(71) Applicant: ABL IP HOLDING LLC, Conyers, GA (US)

(72) Inventors: Guan-Bo Lin, Reston, VA (US); Gregory Malone, Herndon, VA (US); Hampton Boone Maher, Washington, DC (US); Rashmi Kumar Raj, Herndon, VA (US); David P. Ramer, Reston, VA (US)

(73) Assignee: ABL IP HOLDING LLC, Conyers, GA (US)

( * ) Notice: Subject to any disclaimer, the term of this patent is extended or adjusted under 35 U.S.C. 154(b) by 0 days.

(21) Appl. No.: 15/866,961

(22) Filed: Jan. 10, 2018

(51) Int. Cl.
*H05B 33/08* (2006.01)
*G09G 3/3233* (2016.01)
*G09G 3/3258* (2016.01)

(52) U.S. Cl.
CPC ..... *H05B 33/0806* (2013.01); *H05B 33/0848* (2013.01); *H05B 33/0884* (2013.01)

(58) Field of Classification Search
None
See application file for complete search history.

(56) References Cited

U.S. PATENT DOCUMENTS

2010/0110682 A1* 5/2010 Jung ..... H05B 33/0869 362/249.02
2017/0061904 A1 3/2017 Lin et al.
2017/0292681 A1 10/2017 Lin et al.
2018/0005590 A1 1/2018 Komanduri et al.
2018/0018749 A1 1/2018 Goodman et al.

* cited by examiner

*Primary Examiner* — Dedei K Hammond
(74) *Attorney, Agent, or Firm* — RatnerPrestia

(57) ABSTRACT

Disclosed herein is a lighting device including a luminaire having a first light emitter configured to output image and a second light emitter configured to output illumination light. The first light emitter is oriented with the second light emitter such that an available output region of the second light emitter at least substantially overlaps an available output region of the first light emitter. The lighting device also includes a processing system coupled to a driver system, which is coupled to the luminaire. The processing system, via the driver system, is configured to operate the first light emitter to output the image and operate the second light emitter to output the illumination light; and during the operations of the first and light emitters to output a combined light via the substantial overlap, to control the output of at least one of the image or the illumination light to control flicker due to interaction of a portion of the image and a portion of the illumination light.

30 Claims, 19 Drawing Sheets

CONTROLLING FLICKER CAUSED BY MULTIPLE LIGHT SOURCES

TECHNICAL FIELD

The present subject matter relates to a lighting device or luminaire, and/or operations thereof, where the luminaire includes multiple light sources with distinct light waveforms output in approximately the same direction that may cause flicker due to substantial overlapping of the multiple light outputs, and more specifically to control strategies for use in such a luminaire to control the flicker caused by the multiple light sources with distinct light output waveforms.

BACKGROUND

Many light sources with distinct waveforms exist today that provide for multiple uses. Such light sources include artificially powered electrical lighting devices which provide general illumination. Electrically powered artificial lighting has become ubiquitous in modern society. Electrical lighting devices are commonly deployed, for example, in homes, buildings of commercial and other enterprise establishments, as well as in various outdoor settings. Typical luminaires generally have been single purpose devices, e.g. to just provide light output of a character (e.g. color, intensity, and/or distribution) to provide artificial general illumination of a particular area or space.

Another such light source includes displays or display like devices that provide light output representing a visible image. Recently, there have been proposals to combine some degree of display capability with lighting functionalities. The Fraunhofer Institute, for example, has demonstrated lighting equipment using luminous tiles, each having a matrix of red (R) LEDs, green (G), blue (B) LEDs and white (W) LEDs as well as a diffuser film to process light from the various LEDs. The LEDs of the system were driven to simulate or mimic the effects of clouds moving across the sky. Although use of displays allows for variations in appearance that some may find pleasing, the displays or display-like devices are optimized for image output and do not provide particularly good illumination for general lighting applications. There have also been proposals to add controlled lighting devices to televisions sets. Other proposals suggest a lightbulb like device that can serve alternately as an illumination light source and as a projector.

Combining display and illumination functions into a single device, however, leads to other problems such as a flicker. A flicker is interference between two light sources. It is an unpleasant effect caused by poorly considered luminaire design. Flicker usually causes discomforts such as headache, fatigue, dizziness and nausea to humans. Flicker tends to become more problematic for display-illumination integrated device since there are two systems involved in such a device. Lacking consideration of harmonically presenting both display image and illumination results in annoying flicker. Thus there is a need for technical improvements in display-illumination integrated device to control the flicker.

SUMMARY

A luminaire offers multiple light sources with distinct waveforms such that a light source among the multiple light sources is oriented to output light in approximately the same direction as some or all of the light output from another light source. In such a luminaire, the source output orientations cause substantial overlap between the two distinct light outputs; and differences in the light output waveforms may result in a visual flicker. Hence, examples disclosed herein coordinate the distinct light outputs so as to control flicker of the two distinct light outputs.

An example lighting device includes a luminaire having a first light emitter and a second light emitter. The first light emitter includes a first light emission matrix configured to output light from the first emission matrix as a representation of an image. The second light emitter includes a second light emission matrix configured to output illumination light from the second light emission matrix. The first light emitter is oriented with the second light emitter such that an available output region of the second light emission matrix at least substantially overlaps an available output region of the first light emission matrix. The lighting device also includes a driver system coupled to the luminaire to control light outputs generated by the first and second light emission matrices. The lighting device also includes a processing system coupled to the driver system. The processing system is configured to operate the first light emitter and the second light emitter via the driver system to implement functions. Such functions include to operate the first light emission matrix to output the light of the image via an output of the first light emitter; operate the second light emission matrix to output the illumination light via an output of the second light emitter; and during the operations of the first and second light emission matrices to output a combined light via the substantial overlap, to control the output of at least one of the light of the image or the illumination light to control flicker due to interaction of a portion of the light from the first light emission matrix and a portion of the illumination light from the second light emission matrix.

An example method includes operating a first light emission matrix to output light of an image via an output of a first light emitter. The method also includes operating a second light emission matrix to output illumination light via an output of a second light emitter. The method also includes during the operations of the first and second light emission matrices, outputting a combined light. The method further includes controlling the output of at least one of the light of the image or the illumination light to control flicker due to interaction of a portion of the light from the first light emitter and a portion of the illumination light from the second light emitter.

Additional objects, advantages and novel features of the examples will be set forth in part in the description which follows, and in part will become apparent to those skilled in the art upon examination of the following and the accompanying drawings or may be learned by production or operation of the examples. The objects and advantages of the present subject matter may be realized and attained by means of the methodologies, instrumentalities and combinations particularly pointed out in the appended claims.

BRIEF DESCRIPTION OF THE DRAWINGS

The drawing figures depict one or more implementations, by way of example only, not by way of limitations. In the figures, like reference numerals refer to the same or similar elements.

DETAILED DESCRIPTION

Figure 1:
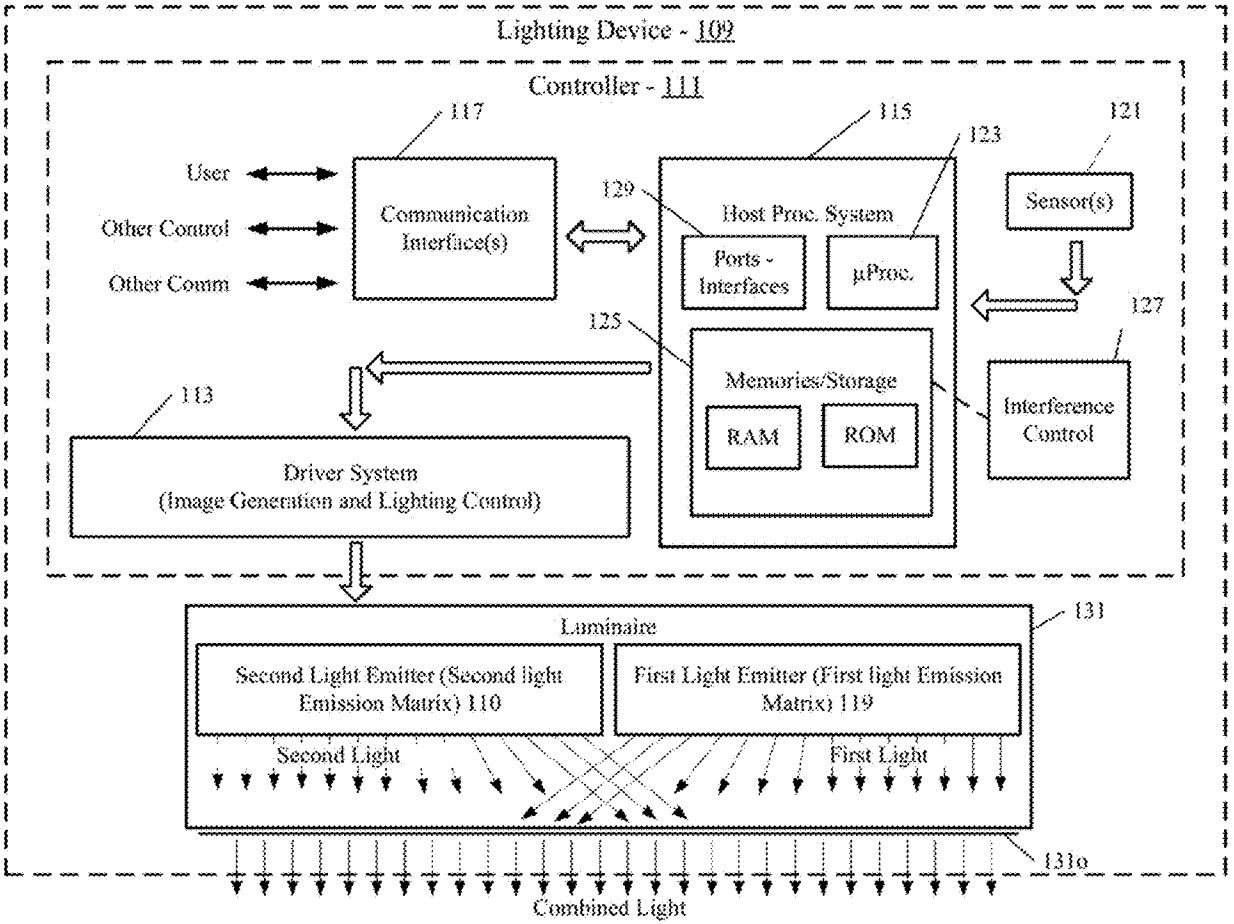
FIG. 1 is a high level functional block diagram of a lighting device that includes a luminaire that may support concurrent display image light output and illumination light output, where the control element(s) of the lighting device are configured to implement one or more of the flicker control strategies.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

In one implementation, a luminaire having functionality of two light sources, disclosed herein are examples that relate to control strategies that coordinate combined light output of the two light sources. In one example, a first light source among the two light sources is a general illumination light source and the second light source among the two light sources is an image display. As such, for the luminaire offering both the illumination and the display functionality, the various examples disclosed herein relate to control strategies that coordinate illumination/image output so as to control flicker of the illumination light output with aspects of the displayed image light output.

The term "luminaire," as used herein, is intended to encompass essentially any type of device that processes energy to generate or supply artificial light, for example, for general illumination of a space intended for use of or occupancy or observation, typically by a living organism that can take advantage of or be affected in some desired manner by the light emitted from the device. However, a luminaire may provide light for use by automated equipment, such as sensors/monitors, robots, etc. that may occupy or observe the illuminated space, instead of or in addition to light provided for an organism. However, it is also possible that one or more luminaries in or on a particular premises have other lighting purposes, such as signage for an entrance or to indicate an exit. In most examples, the luminaire(s) illuminate a space or area of a premises to a level useful for a human in or passing through the space, e.g. general illumination of a room or corridor in a building or of an outdoor space such as a street, sidewalk, parking lot or performance venue. The actual source of illumination light in or supplying the light for a luminaire may be any type of artificial light emitting device, several examples of which are included in the discussions below.

The illumination light output of a luminaire, for example, may have an intensity and/or other characteristic(s) that satisfy an industry acceptable performance standard for a general lighting application. The performance standard may vary for different uses or applications of the illuminated space, for example, as between residential, office, manufacturing, warehouse, or retail spaces.

Terms such as "artificial lighting," as used herein, are intended to encompass essentially any type of lighting in which a luminaire produces light by processing of electrical power to generate the light. A luminaire for artificial lighting, for example, may take the form of a lamp, light fixture, or other luminaire that incorporates a light source, where the light source by itself contains no intelligence or communication capability, such as one or more LEDs or the like, or a lamp (e.g. "regular light bulbs") of any suitable type.

In the examples below, the luminaire includes at least one or more components forming a lighting source for generating the artificial illumination light for a general lighting application as well as a co-located display device, e.g. integrated/combined with the lighting component(s) of the lighting source into the one structure of the luminaire. The co-located display device is a device configured to emit light representing a stationary or moving image. The lighting source and the display device may be configured/oriented in the luminaire such that the regions or areas of the light outputs from the lighting source and the display device at least substantially overlap. The output light from the lighting source and the display device tend to combine, particularly at a distance from the luminaire where the luminaire provides artificial illumination and the displayed image may be visible to an observer in the space lighted by the luminaire.

In several illustrated examples, such a combinatorial luminaire may take the form of a light fixture, such as a pendant or drop light or a downlight, or wall wash light or the like. Other fixture mounting arrangements are possible. For example, at least some implementations of the luminaire may be surface mounted on or recess mounted in a wall, ceiling or floor. Orientation of the luminaires and components thereof are shown in the drawings and described below by way of non-limiting examples only. The luminaire with the lighting component(s) and the display device may take other forms, such as lamps (e.g. table or floor lamps or street lamps) or the like. Additional devices, such as fixed or controllable optical elements, may be included in the luminaire, e.g. to distribute light output from the display device and/or the illumination light source. Luminaires in the examples shown in the drawings and described below have display and illumination components oriented to output image light in approximately the same direction as some or all of the illumination light.

Examples of suitable luminaires include a first light emitter for example, a source for the display device that includes a first light emission matrix configured to output light from the first emission matrix as a representation of an image. The luminaire also includes a second light emitter for example, a source for the artificial illumination function that includes a second light emission matrix configured to output illumination light from the second light emission matrix. At an output of the luminaire, available output regions of the light emission matrices of the general illumination light source and the display at least substantially overlap. The output light from the source and the display emitters tend to combine, particularly at a distance from the luminaire where the luminaire provides artificial illumination and the displayed image may be visible to an observer in the space lighted by the luminaire. For example, the image light and illumination light may be emitted from a common output area or surface of the luminaire, although the two types of light may have somewhat different angular light distributions and/or emerge via different portions of the output area or surface of the luminaire. In an example luminaire with a common output area or surface, if the overlap of the available output regions is complete, both matrices extend across and include sufficient controllable emitters to selectively emit display light and illumination light across the entire luminaire output. In such an example luminaire, the emission matrices also can selectively emit display light and illumination light through any selected smaller portion or area within the luminaire output. Other arrangements of the emission matrices supporting concurrent image output and controllable general illumination, with less complete overlap of the available output regions may still serve as the luminaires in lighting devices that implement the flicker control strategies under consideration herein. A luminaire of a type supporting display and general illumination functions may operate in various modes, e.g. with the display ON while the illumination is OFF or with the display OFF while the illumination is ON. The flicker control strategies under consideration here, however, are most useful when a luminaire is emitting at least some display light and at least some general illumination light concurrently.

Terms such as "display" (noun) and "display device" as used herein are intended to encompass essentially any type of hardware device that selectively processes energy to controllably output light representing an image. Display devices may or may not include light generating elements. A pixel is a unit area of an image. On a display device, for example, a pixel is point or small unit of area of light as part of an image presented in the image display output. A display may be selectively controlled to emit light of a different color and intensity at each pixel point/area of the image display output. The image output light may be generated directly by the display pixel emitters (e.g. by direct emissions from LEDs, OLEDs or plasmas at the pixel points of the display), by controlled filtering of source light (e.g. by red, green, blue LCD filters at the pixel points), or by reflection of source light (e.g. by electrophoretic ink pixel points). In other examples of the image display device, a projector of any suitable type may project the display image onto a transmissive or reflective screen. In this later case, the combination of the projector and screen form the display. In a further alternative example, the projector (alone) may be the display device located/configured to output light to project the image onto a structural surface (e.g. wall or ceiling) not itself a component of the luminaire.

Terms such as "lighting device" or "lighting apparatus," as used herein, are intended to encompass essentially any combination of an example of a luminaire discussed herein with other elements such as electronics and/or support structure, to operate and/or install the particular luminaire implementation. Such electronics hardware, for example, may include some or all of the appropriate driver(s) for the illumination light source and the display, any associated control processor or alternative higher level control circuitry, and/or data communication interface(s). As noted, the lighting component(s) and display are co-located into an integral unit, such as a light fixture or lamp implementation of the luminaire. The electronics for driving and/or controlling the lighting component(s) and the display may be incorporated within the luminaire or located separately and coupled by appropriate means to the light source component(s) and the display device.

The term "lighting system," as used herein, is intended to encompass essentially any type of system that either includes a number of such lighting devices coupled together for data communication or a lighting device coupled together for data communication with one or more control devices, such as wall switches, control panels, remote controls, central lighting or building control systems, servers, etc.

In several of the examples, the lighting device is software configurable, by programming instructions and/or setting data, e.g. which may be communicated to a processor of the lighting device via a data communication network of a lighting system. Configurable aspects of lighting device operation may include one or more of: a selected image (still or video) for presentation as the image output from the display, and one or more parameters (such as intensity and various color related characteristics) of the illumination light output. If the luminaire also includes an optical device or system for variably controlling or modulating the light output distribution(s), as in several examples, one or more parameters of the output distribution (e.g. beam shape and beam angle of the image light and/or the illumination light) also would be configurable by setting data or instructions communicated to and/or stored in the lighting. An example of a software configurable lighting device, with the luminaire thereof installed for example as a panel or pendant type light fixture, may offer the capability to emulate performance of a variety of different lighting devices for general lighting applications, while presenting any desired appearance via the image display output.

The term "coupled" as used herein refers to any logical, physical or electrical connection, link or the like by which signals produced by one element are imparted to another "coupled" element. Unless described otherwise, coupled components, elements or devices are not necessarily directly connected to one another and may be separated by intermediate components, elements, devices or communication media that may modify, manipulate or carry the signals.

Reference now is made in detail to the examples illustrated in the accompanying drawings and discussed below. FIG. 1 illustrates an example of a lighting device 109 including a luminaire 131 as part of the lighting device 109. In the simplified block diagram example, the luminaire 131 includes a first light emitter 119 and a second light emitter 110. The first light emitter 119 includes a first light emission matrix configured to output light from the first light emission matrix through the luminaire output 131*o*. The second light emitter 110 includes a second light emission matrix configured to output light from the second light emission matrix through the luminaire output 131*o*.

In most examples, the luminaire 131 includes two relatively separate and distinct emission matrices, although there may be additional emission matrices, or the emission matrices functionalities thereof may be combined into one physical matrix of suitable emitters. In the example with two physical matrices, the matrices are oriented such that an available output region of the second light emission matrix at least substantially overlaps an available output region of the first light emission matrix, as generally represented by overlapping emission arrows from the second light emitter 110 and the first light emitter 119 and by the arrows for superimposed or combined light (interaction of the light from the first light emitter 119 with the light from the second light emitter 110) output from the luminaire output 131*o*. In one implementation, as shown, the two physical matrices are co-located.

To implement the flicker control strategy, one or both of the second light emission matrix of the second light emitter 110 and the first light emission matrix of the first light emitter 119 will have sufficient emitters to achieve levels of expected light output levels corresponding to specified intensity settings with some of the emitters of that matrix OFF or operating at low intensity. In one example, some or all the emitters of the first light emitter 119 of the first light emission matrix operate. In another example, some or all the emitters of the second light emitter 110 of the second light emission matrix operate. The first light emission matrix concurrently operates with the second light emission matrix.

In one implementation example, the lighting device 109 includes a controller 111 including a driver system 113 that is coupled to the luminaire 131 to control light outputs generated by the first and the second light emission matrices in the first light emitter 119 and the second light emitter 110 respectively. Although the driver system 113 is implemented as the element of the controller 111, the driver system 113 may be separately located from other elements of the controller 111. The driver system 113 may be implemented as an integrated driver circuit, although in many cases, the driver system 113 may include two separate driver circuits, one specifically adapted to provide suitable drive signals to the emitters of the particular implementation of the second light emission matrix of the second light emitter 110 and another specifically adapted to provide suitable drive signals to the emitters of the first light emitter 119. Although active-matrix driver circuitry may be used in the driver system 113 to drive one or both of the emission matrices, passive matrix driver circuitry may be used to drive one or both of the emission matrices. For example, a passive matrix driver circuit may be a more cost effective solution to drive one or both of the emission matrices, particularly for any emission matrix that need not be dynamically controlled at a fast refresh rate. Both active matrix drivers and passive matrix drivers can independently control pixel outputs. In any event, the controllable luminaire 131 provides light output from second light emitter 110 in response to lighting control signals received from the driver system 113. Similarly, the controllable luminaire 131 provides light output from the first light emitter 119 in response to control signals received from the driver system 113.

FIG. 1 provides a high level functional block diagram of an example of an implementation of a lighting device 109 that includes a luminaire 131 that may support concurrent light outputs from two light emitters, where the control element(s) of the lighting device 109 are configured to implement one or more of the flicker control strategies as discussed herein. As shown in FIG. 1, in one example, the controller 111 includes a host processor system 115, one or more sensors 121 and one or more communication interface(s) 117. Other implementations of the circuitry of the controller 111 may be utilized.

As shown in FIG. 1, the host processor system 115 is coupled to control operation of the driver system 113, and through the driver system 113 to control the combined light output from the luminaire 131. With advances in circuit design, driver circuitry could be incorporated together with circuitry of the host processor system. Other circuitry may be used in place of the processor based host system 115 (e.g. a purpose built logic circuit or an ASIC). In the illustrated example, the driver system 113 together with higher layer control elements of the lighting device 109, such as the host processor system 115, serve as means for controlling the second light emission matrix of the second light emitter 110 and the first light emission matrix of the first light emitter 119 to control flicker of light output from the second light emitter 110 with concurrently emitted light from the first light emitter 119.

The circuitry of the controller 111 may be configured to operate the second light emitter 110 to generate the corresponding light at least during a first state of the luminaire 131, and to operate the second light emitter 119 to emit the corresponding light at least during a second state of the luminaire 131. Although first and the second states could occur separately, e.g. at non-overlapping times, the flicker control strategies under discussion here are applicable to states in which the luminaire 131 produces both types of light concurrently for simultaneous output at 131*o*.

In the example of FIG. 1, the host processor system 115 provides the high level logic or "brain" of the controller 111 and thus of the lighting device 109. In the example, the host processor system 115 includes memories/storage 125, such as a random access memory (RAM) and/or a read-only memory (ROM), as well as program instructions and/or data for the flicker control capability 127 stored in one or more of the memories/storage 125 to control the light outputs of the second light emitter 110 and the first light emitter 119. The flicker control 127, in one example, configures the lighting device 109 to implement light outputs from the first and the second light emitters 119 and 110 respectively via the controlled luminaire 131 with a flicker control strategy.

At a high level, the host processor system 115 is configured to operate the second light emitter 110 and the first light emitter 119 via the driver system 113 to implement functions, including light output functions which also involve a flicker control strategy. For example, the first light emission matrix is operated so that the first light emitter 119 outputs the light via an output 1310 of the luminaire 131.

More specifically, the host processor system 115 controls operation of the luminaire 131 based on light settings corresponding to the first and the second light emitters 119 and 110 respectively, which may be stored in memory 125 in the controller 111 or received as streaming data for temporary storage (buffering in local memory). Operation also is controlled, based on programming of the host processor system 115 and/or appropriate light source control data, including to implement one or a combination of the flicker control strategies as discussed herein.

Hence, the memories/storage 125 may also store various data, including luminaire configuration information or one or more configuration files containing such information (e.g. an image, illumination setting data, communication configuration or other provisioning data, or the like) in addition to the illustrated flicker control 127. Light source control data may be generated or adjusted to implement a flicker control strategy. The relevant data may be generated remotely at a server or the like and implemented in the light setting data streamed or downloaded to the controller 111. Alternatively, the analysis of the light outputs of the first and the second light emitters 119 and 110 respectively to control flicker may be implemented by the host processor system 115, based on appropriate programming instructions of the flicker control 127 stored in the memory 125. Thus, programming or control data used by the host processing system 115 is configured to implement control of operation of the second light emitter 110 of the luminaire 131 when outputting corresponding light responsive to a received or stored setting while the first light emitter 119 of the luminaire 131 is concurrently outputting corresponding light of based on received or stored light data.

In the example with two physical matrices, the matrices are oriented (for e.g. co-located) such that an available output region of the second light emission matrix at least substantially overlaps an available output region of the first light emission matrix, as generally represented by overlapping emission arrows from the second light emitter 110 and the first light emitter 119 and by the arrows for combined light output from the luminaire output 131*o*.

The host processor system 115 includes a central processing unit (CPU), shown by way of example as a microprocessor (μProc.) 123, although other processor hardware may serve as the CPU. The CPU and memories, for example, may be implemented by a suitable system-on-a-chip often referred to as a micro-control unit (MCU). In a microprocessor implementation, the microprocessor may be based on any known or available microprocessor architecture, such as a Reduced Instruction Set Computing (RISC) using ARM architecture, as commonly used today in mobile devices and other portable electronic devices. Of course, other microprocessor circuitry may be used to form the processor 123 of the controller 111. The processor 123 may include one or more cores. Although the illustrated example includes only one microprocessor 123, for convenience, a controller 111 may use a multi-processor architecture.

The ports and/or interfaces 129 couple the processor 123 to various elements of the lighting device 109 logically outside the host processor system 115, such as the driver system 113, the communication interface(s) 117 and the sensor(s) 121. For example, the processor 123 by accessing programming 127 in the memory 125 controls operation of the driver system 113 and thus operations of the luminaire 131 via one or more of the ports and/or interfaces 129. In a similar fashion, one or more of the ports and/or interfaces 129 enable the processor 123 of the host processor system 115 to use and communicate externally via the interface(s) 117; and one or more of the ports 129 enable the processor 123 of the host processor system 115 to receive data regarding any condition detected by a sensor 121, for further processing.

In the operational examples, based on its programming and/or data for flicker control 127, the processor 123 processes data retrieved from the memory 123 and/or other data storage, and responds to light setting parameters in the configuration data retrieved from memory 125 to control the light generation by the second light emitter 110. The light output control also may be responsive to sensor data from a sensor 126. The configuration file(s) in memory 125 may also provide light data, which the host processor system 115 uses to control the driver and thus the light emission from the first light emitter 119.

As noted, the host processor system 115 is coupled to the communication interface(s) 117. In the example, the communication interface(s) 117 offer a user interface function or communication with hardware elements providing a user interface for the lighting device 109. The communication interface(s) 117 may communicate with other control elements, for example, a host computer of a building control and automation system (BCAS). The communication interface(s) 117 may also support device communication with a variety of other equipment of other parties having access to the lighting device 109 in an overall/networked lighting system encompassing a number of lighting devices 109, e.g. for access to each lighting device 109 by equipment of a manufacturer for maintenance or access to an on-line server for downloading of programming instruction or configuration data for setting aspects of luminaire operation.

In an example of the operation of the lighting device 109, the processor 123 receives a configuration file via one or more of the communication interfaces 117. The processor 123 may store, or cache, the received configuration file in storage/memories 125. The file may include light data, or the processor 123 may receive separate light data via one or more of the communication interfaces 117. The light data may be stored, as part of or along with the received configuration file in storage/memories 125. A software configurable lighting device such as device 109 may be reconfigured, e.g. to change data of the light output and/or to change one or more parameters of the light output, by changing the corresponding aspect(s) of the configuration data file, by replacing the configuration data file, or by selecting a different file from among a number of such files already stored in the data storage/memories 125.

In other examples, the lighting device 109 may be programmed to transmit information on the light output from the luminaire 131. Examples of information that the lighting device 109 may transmit in this way include a code, e.g. to identify the luminaire 131 and/or the lighting device 109 or to identify the luminaire location. Alternatively or in addition, the light output from the luminaire 131 may carry downstream transmission of communication signaling and/or user data.

Apparatuses implementing functions like those of configurable lighting device 109 may take various forms. For example, a lighting device 109 may have all of the above hardware components on or within a single hardware platform as shown in FIG. 1 or some components attributed to the lighting device 109 may be separated from the second light emitter 110 and the first light emitter 119 in the luminaire 131 in different somewhat separate units. In a particular example, one set of the hardware components may be separated from one or more instances of the controllable luminaire 131, e.g. such that one host processor system 115 may control several luminaires 131 each at a somewhat separate location wherein one or more of the controlled luminaires 131 are at a location remote from the one host processor system 115. In such an example, a driver system 113 may be located near or included in a combined platform with each luminaire 131. For example, one set of intelligent components, such as the microprocessor 123, may control/drive some number of driver systems 113 and associated controllable luminaires 131. Alternatively, there may be one overall driver system 113 located at or near the host processor system 115 for driving some number of luminaires 131. It also is envisioned that some lighting devices may not include or be coupled to all of the illustrated elements, such as the sensor(s) 121 and the communication interface(s) 117. For convenience, further discussion of the lighting device 109 of FIG. 1 will assume an intelligent implementation of the lighting device 109 that includes at least the illustrated components.

In addition, the luminaire 131 is not size restricted. For example, each luminaire 131 may be of a standard size, e.g. 2-feet by 2-feet (2×2), 2-feet by 4-feet (2×4), or the like, and arranged like tiles for larger area coverage. Alternatively, one luminaire 131 may be a larger area device that covers a wall, a part of a wall, part of a ceiling, an entire ceiling, or some combination of portions or all of a ceiling and wall.

In one implementation, the first and the second light emitters 119 and 110 are same type of light sources. In one example, both the first and the second light emitters 119 and 110 are general illumination light sources as discussed in detail below.

Figure 1A:
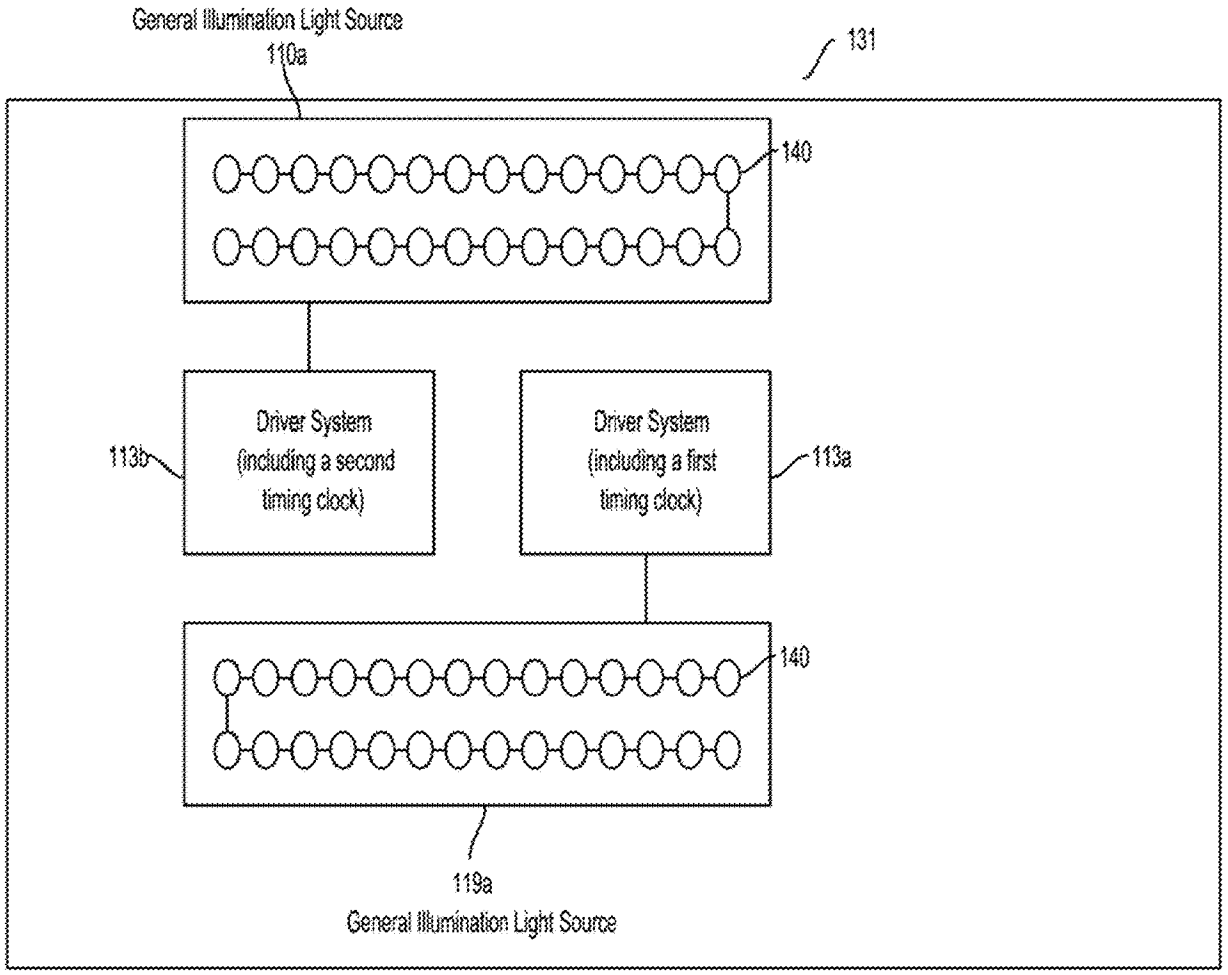
FIG. 1A is a high level functional block diagram of an example of the luminaire of FIG. 1.

FIG. 1A provides a high level functional block diagram of an example of a luminaire 131 of FIG. 1. As shown, the first light emitter 119 is a general illumination light source 119*a* including a plurality of LEDs 140 and the second light emitter 110 is also a general illumination light source 110*b* also including the plurality of LEDs 140. In this example, the luminaire 131 also includes a driver system 113*a* including a first timing clock coupled to the general illumination light source 119*a*. Further the luminaire 131 also includes a driver system 113*b* including a second timing clock coupled to the general illumination light source 110*a*. Each of the driver systems 113*a* and 113*b* function to synchronize clock frequency utilizing the first and the second timing clocks respectively.

In one implementation, the flicker is mitigated via synchronization of clock frequency of both the general illumination light sources 119*a* and 110*a*. In one example, the driver system 113*a* synchronizes the clock frequency of the general illumination light source 119*a* to be same as the clock frequency of the general illumination light source 110*a* generated by the driver system 113*b*. In another example, the driver system 113*b* synchronizes the clock frequency of the general illumination light source 110 to be same as the clock frequency of the general illumination source 119*a* generated by the driver system 113*a*. Such synchronization results in the superimposed or combined light (interaction of the light from the general illumination light source 119*a* with the light from the general illumination light source 110*a*) that outputs the same frequency. In these implementations of synchronizing the frequencies of the general illumination light sources 110*a* and 119*a*, the frequency of the combined light is above a frequency of a flicker fusion threshold and thus the flicker is not perceived by a human. In one implementation, human perceive flicker at any frequency below the flicker fusion threshold. The flicker fusion threshold is usually below 60 Hz for most people, but some people, with flicker-sensitive eye neurons, can still perceive flicker at frequency above 60 Hz. Therefore, flicker fusion threshold is a human-sensitive number depending on users. In one example, studies showed that the flicker fusion threshold ranges from 50 Hz to 100 Hz.

In one implementation, the driver system 113*b* runs the general illumination light source 110*a* at a first clock frequency and the drive system 113*a* runs the general illumination light source 119*a* at a second clock frequency, which is different from the first clock frequency. A beat frequency is determined between the first and the second clock frequencies. The beat frequency is equal to the difference in frequency of the two waves that interfere to produce 'optical beats'. In one example, the beat frequency (difference between the first and the second clock frequencies) is below a frequency of a flicker fusion threshold, thus flicker is perceived by a human. In one example, a flicker frequency threshold is in the range of 50 Hz-100 Hz. In one implementation, human perceive flicker at any frequency below the flicker fusion threshold. The flicker fusion threshold is usually below 60 Hz for most people, but some people, with flicker-sensitive eye neurons, can still perceive flicker at frequency above 60 Hz. Therefore, flicker fusion threshold is a human-sensitive number depending on users. In one example, studies showed that the flicker fusion threshold ranges from 50 Hz to 100 Hz. In another example, the beat frequency (difference between the first and the second clock frequencies) is above a frequency of a flicker fusion threshold, thus beyond human flicker perception.

In another implementation, the first and the second light emitters 119 and 110 are different type of light sources. In one example, the first light emitters 119 is an image display and the second light source is a general illumination light source as discussed in detail below.

Figure 1B:
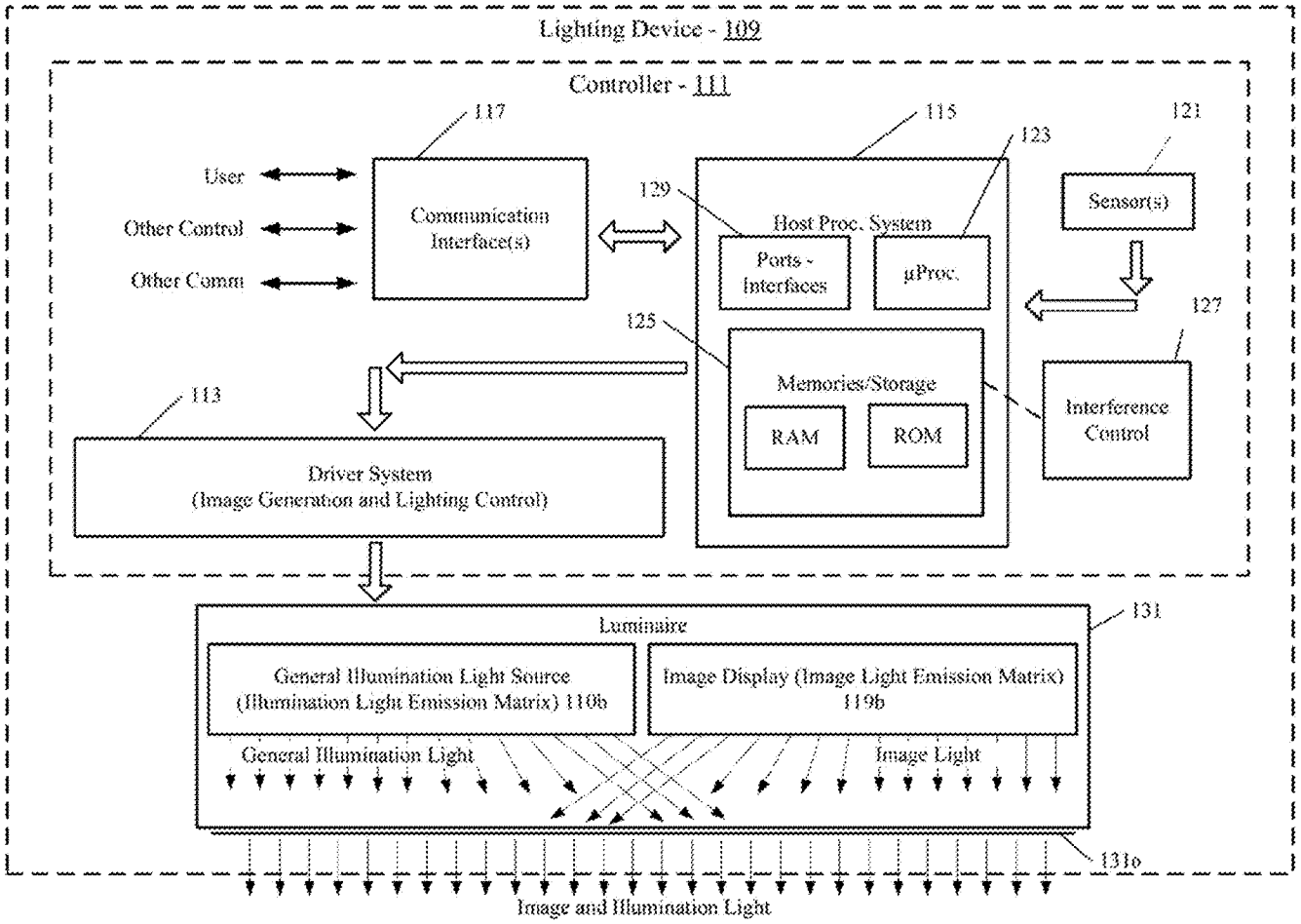
FIG. 1B is a high level functional block diagram of an example of the luminaire in the device of FIG. 1.

FIG. 1B illustrates an example of the lighting device 109 including the luminaire 131 having a general illumination and display functionality. In the illustrated example, the first light emitter 119 is an image display 119*ba* and the second light emitter 110*b* is a general illumination light source 110*b*.

In the simplified block diagram example, the image display 119*ba* includes a first light emission matrix configured to output light from the first light emission matrix, such as image light emission matrix through the luminaire output 131*o*, as a representation of an image. In one implementation, the image is a stationary image. In another implementation, the image is a moving image. For the purposes of the discussion of the luminaire 131, display 119*b* the first light emission matrix is referred to as an image light emission matrix. The display 119*b* is an emissive type display device controllable to emit light of a selected image, e.g. as a still image or a video frame.

The 110*b* general illumination light source 110*b* includes a second light emission matrix. The general illumination light source 110*b*110*b* is configured to output general illumination light from the second light emission matrix via the luminaire output 131*o*. For the purposes of the discussion of the luminaire 131110*b*110*b* the second light emission matrix is referred to as an illumination light emission matrix.

In most examples, the luminaire 131 includes two relatively separate and distinct emission matrices, although there may be additional emission matrices, or the emission matrices functionalities thereof may be combined into one physical matrix of suitable emitters. In the example with two physical matrices, for the general illumination light source and the display, the matrices are oriented such that an available output region of the illumination light emission matrix at least substantially overlaps an available output region of the display light emission matrix, as generally represented by overlapping emission arrows from the light source 110*b* and the display 119*b* and by the arrows for superimposed or combined light (interaction of the light from the display 119*b* with the light from the light source 110*b*) output from the luminaire output 131*o*. In one implementation, as shown, the two physical matrices are co-located. As discussed above, the output light from the lighting source 110*b* and the display 119*b* tend to combine, particularly at a distance from the luminaire 131 where the luminaire 131 provides artificial illumination and the displayed image may be visible to an observer in the space lighted by the luminaire 131.

The display 119*b* may be either a commercial-off-the-shelf image display type device or an enhanced display or the like specifically adapted for use in the luminaire 131. The display 119*b* is configured to output light to present an image. The presented image may be a real scene, a computer generated scene, a single color, a collage of colors, a video stream, animation or the like. The illumination emission matrix of the light source 110*b* may be an otherwise standard general illumination system, of multiple individually controllable emitters. Several examples of the luminaire 131 in which the lighting device and/or the display are specifically configured for use together in a luminaire are discussed later.

The light source 110*b* alone or in combination with light output from the display 119*b* illuminates a space, for example, in compliance with governmental building codes and/or industry lighting standards. The light source 110*b* may have a maximum light generation capability at least at an intensity of 200 lumens. For general lighting examples, lumen outputs of the luminaire 131 may range from 200 to 1600 lumens for typical office or residential applications. Higher lumen outputs may be desirable for commercial or industrial general illumination. These represent examples only of possible maximum output intensities for general illumination, and the light source 110*b* is controllable to provide lower intensity outputs, e.g. for dimming.

To implement the flicker control strategy, the illumination light emission matrix of the light source 110*b* will have sufficient emitters (e.g. of number and lumen output capabilities) to achieve levels of expected lumen output levels corresponding to specified intensity settings with some of the emitters of that matrix OFF or operating at low intensity. In that sense, for concurrent operation of both the display 119*b* and the light source 110*b*, the illumination light emission matrix of the light source 110*b* will have some excess capacity. For higher intensity settings, the luminaire 131 may run an illumination only mode, in which with all of the emitters of the illumination light emission matrix of the light source 110*b* operate. In that mode, some or all of the emitters of the image light emission matrix of the display 119*b* may concurrently operate in a non-display mode, e.g. white output only to further increase the output intensity of light from the luminaire output 1310 or selected color/intensity to tune the color of the light from the luminaire output 1310 by mixing with light from the light source 110*b*.

As discussed above, in one implementation example, the lighting device 109 includes the controller 111 including the driver system 113 that is coupled to the luminaire 131 to control light outputs generated by the image and illumination light emission matrices in the light source 110*b* and the display 119*b* respectively. Although the driver system 113 is implemented as the element of the controller 111, the driver system 113 may be separately located from other elements of the controller 111. The driver system 113 may be implemented as an integrated driver circuit, although in many cases, the driver system 113 may include two separate driver circuits, one specifically adapted to provide suitable drive signals to the emitters of the particular implementation of the illumination light emission matrix of the light source 110*b* and another specifically adapted to provide suitable drive signals to the emitters of the image light emission matrix of the display 119*b*. Although active-matrix driver circuitry may be used in the driver system 113 to drive one or both of the emission matrices, passive matrix driver circuitry may be used to drive one or both of the emission matrices. For example, a passive matrix driver circuit may be a more cost effective solution to drive one or both of the emission matrices, particularly for any emission matrix that need not be dynamically controlled at a fast refresh rate. An issue with passive matrix is that the brightness scales with the number of rows in the emission matrix. It may be acceptable for a display but may not be acceptable for general illumination light source. Both active matrix drivers and passive matrix drivers can independently control pixel outputs, and thus they are the two main methods to create images for display. Either of these two methods may be used for driver circuity for the image display 119*b*. For a driver circuit for the illumination light emission matrix of the light source 110*b*, active matrix or passive matrix driving methods may not be required. For example, in some configurations of the light source 110*b*, general illumination light emitters are arranged together in a group forming a controllable row/column or multiple controllable rows/columns with several parallel series of LEDs. Driving such a matrix then involves controlling a series of lighting emitters together instead of one emitter at each row and column intersection. In this later case, conventional pulse-width modulation driving circuity can tune the light intensity for a series of illumination lighting "pixels." This driving method is more energy efficient and more cost effective than current implementations of active matrix or passive matrix. In any event, the controllable luminaire 131 provides general illumination light output from the light source 110*b* in response to lighting control signals received from the driver system 113. Similarly, the controllable luminaire 131 provides image light output from the display 119*b* in response to image control signals received from the driver system 113.

FIG. 1B provides a high level functional block diagram of an example of an implementation of a lighting device 109 of FIG. 1 that includes a luminaire 131 that may support concurrent display image light output and illumination light output, where the control element(s) of the lighting device 109 are configured to implement one or more of the flicker control strategies as discussed herein. As discussed above, as shown in FIG. 1B, in one example, the controller 111 includes the host processor system 115, one or more of the sensors 121 and one or more of the communication interface(s) 117. Other implementations of the circuitry of the controller 111 may be utilized.

As shown in FIG. 1B, the host processor system 115 is coupled to control operation of the driver system 113, and through the driver system 113 to control illumination and image light output from the luminaire 131. With advances in circuit design, driver circuitry could be incorporated together with circuitry of the host processor system. Other circuitry may be used in place of the processor based host system 115 (e.g. a purpose built logic circuit or an ASIC). In the illustrated example, the driver system 113 together with higher layer control elements of the lighting device 109, such as the host processor system 115, serve as means for controlling the illumination light emission matrix of the light source 110*b* and the image light emission matrix of the display 119*b* to control flicker of illumination light output with concurrently emitted light of the image.

The circuitry of the controller 111 may be configured to operate the light source 110*b* to generate the illumination light at least during an illumination state of the luminaire 131, and to operate the display 119*b* to emit the light of the image at least during an image display state of the luminaire 131. Although these illumination and display states could occur separately, e.g. at non-overlapping times, the flicker control strategies under discussion here are applicable to states in which the luminaire 131 produces both types of light concurrently for simultaneous output at 131*o*.

In the example of FIG. 1B, the host processor system 115 provides the high level logic or "brain" of the controller 111 and thus of the lighting device 109. In the example, the host processor system 115 includes memories/storage 125, such as a random access memory (RAM) and/or a read-only memory (ROM), as well as program instructions and/or data for the flicker control capability 127 stored in one or more of the memories/storage 125 to control the light outputs of the light source 110*b* and the display 131. The flicker control 127, in one example, configures the lighting device 109 to implement display and illumination via the controlled luminaire 131 with a flicker control strategy.

At a high level, the host processor system 115 is configured to operate the light source 110*b* and the display 119*b* via the driver system 113 to implement functions, including illumination and image output functions which also involve a flicker control strategy. For example, the first light emission matrix is operated so that the display 119*b* outputs the light of the image via an output 1310 of the luminaire 131.

More specifically, the host processor system 115 controls operation of the luminaire 131 based on image data and a general illumination light setting, which may be stored in memory 125 in the controller 111 or received as streaming data for temporary storage (buffering in local memory). Operation also is controlled, based on programming of the host processor system 115 and/or appropriate illumination source control data, including to implement one or a combination of the flicker control strategies as discussed herein.

Hence, the memories/storage 125 may also store various data, including luminaire configuration information or one or more configuration files containing such information (e.g. an image, illumination setting data, communication configuration or other provisioning data, or the like) in addition to the illustrated flicker control 127. Light source control data may be generated or adjusted to implement a flicker control strategy. The relevant data may be generated remotely at a server or the like and implemented in the illumination setting data streamed or downloaded to the controller 111. Alternatively, the analysis of the image and associated control of the light source 110*b* to control flicker may be implemented by the host processor system 115, based on appropriate programming instructions of the flicker control 127 stored in the memory 125. Thus, programming or control data used by the host processing system 115 is configured to implement control of operation of the light source 110*b* of the luminaire 131 when outputting general illumination light responsive to a received or stored setting while a display 119*b* of the luminaire 131 is concurrently outputting light of an image based on received or stored image data.

In the example with two physical matrices, for the general illumination light source and the display, the matrices are oriented (for e.g. co-located) such that an available output region of the illumination light emission matrix at least substantially overlaps an available output region of the display light emission matrix, as generally represented by overlapping emission arrows from the light source 110*b* and the display 119*b* and by the arrows for combined light output from the luminaire output 131*o*.

The host processor system 115 includes a central processing unit (CPU), shown by way of example as the microprocessor (μProc.) 123, although other processor hardware may serve as the CPU. The CPU and memories, for example, may be implemented by a suitable system-on-a-chip often referred to as a micro-control unit (MCU). In a microprocessor implementation, the microprocessor may be based on any known or available microprocessor architecture, such as a Reduced Instruction Set Computing (RISC) using ARM architecture, as commonly used today in mobile devices and other portable electronic devices. Of course, other microprocessor circuitry may be used to form the processor 123 of the controller 111. The processor 123 may include one or more cores. Although the illustrated example includes only one microprocessor 123, for convenience, a controller 111 may use a multi-processor architecture.

The ports and/or interfaces 129 couple the processor 123 to various elements of the lighting device 109 logically outside the host processor system 115, such as the driver system 113, the communication interface(s) 117 and the sensor(s) 121. For example, the processor 123 by accessing the programming 127 in the memory 125 controls operation of the driver system 113 and thus operations of the luminaire 131 via one or more of the ports and/or interfaces 129. In a similar fashion, one or more of the ports and/or interfaces 129 enable the processor 123 of the host processor system 115 to use and communicate externally via the interface(s) 117; and one or more of the ports 129 enable the processor 123 of the host processor system 115 to receive data regarding any condition detected by a sensor 121, for further processing.

In the operational examples, based on its programming and/or data for flicker control 127, the processor 123 processes data retrieved from the memory 123 and/or other data storage, and responds to illumination setting parameters in the configuration data retrieved from memory 125 to control the light generation by the light source 110*b*. The light output control also may be responsive to sensor data from a sensor 126. The light output parameters may include either one or both of light intensity and light color characteristics of the light from light source 110*b*, either for overall light generated by the light source 110*b* or sub-groups of one or more emitters, among the matrix of emitters of the light source 110*b*. The illumination light setting parameters may also control modulation of the light output, e.g. to carry information on the illumination light output of the luminaire 131 and/or to spatially modulate illumination light output distribution (if the luminaire 131 includes an optical modulator, not shown). The configuration file(s) in memory 125 may also provide the image data, which the host processor system 115 uses to control the display driver and thus the light emission from the display 119*b*.

As noted, the host processor system 115 is coupled to the communication interface(s) 117. In the example, the communication interface(s) 117 offer a user interface function or communication with hardware elements providing a user interface for the lighting device 109. The communication interface(s) 117 may communicate with other control elements, for example, a host computer of a building control and automation system (BCAS). The communication interface(s) 117 may also support device communication with a variety of other equipment of other parties having access to the lighting device 109 in an overall/networked lighting system encompassing a number of lighting devices 109, e.g. for access to each lighting device 109 by equipment of a manufacturer for maintenance or access to an on-line server for downloading of programming instruction or configuration data for setting aspects of luminaire operation.

In an example of the operation of the lighting device 109, the processor 123 receives a configuration file via one or more of the communication interfaces 117. The processor 123 may store, or cache, the received configuration file in storage/memories 125. The file may include image data, or the processor 123 may receive separate image data via one or more of the communication interfaces 117. The image data may be stored, as part of or along with the received configuration file in storage/memories 125. Alternatively, image data (e.g. video) and/or general illumination light setting data may be received as streaming data and used to drive the display 119*b* in real-time. A software configurable lighting device such as device 109 may be reconfigured, e.g. to change the image display output and/or to change one or more parameters of the illumination light output, by changing the corresponding aspect(s) of the configuration data file, by replacing the configuration data file, or by selecting a different file from among a number of such files already stored in the data storage/memories 125.

The driver system 113 may deliver the image data directly to the display 119*b* for presentation or may convert the image data into a signal or data format suitable for delivery to the display 119*b*. For example, the image data may be video data formatted according to compression formats, such as H. 264 (MPEG-4 Part 10), HEVC, Theora, Dirac, RealVideo RV40, VP8, VP9, or the like, and still image data may be formatted according to compression formats such as Portable Network Group (PNG), Joint Photographic Experts Group (JPEG), Tagged Image File Format (TIFF) or exchangeable image file format (Exif) or the like. For example, if floating point precision is needed, options are available, such as OpenEXR, to store 32-bit linear values. In addition, the hypertext transfer protocol (HTTP), which supports compression as a protocol level feature, may also be used. For at least some versions of the display 119*b* offering a low resolution image output, higher resolution source image data may be down-converted to a lower resolution format, either by the host processor system 115 or by processing in the circuitry of the driver system 113.

In other examples, the lighting device 109 may be programmed to transmit information on the light output from the luminaire 131. Examples of information that the lighting device 109 may transmit in this way include a code, e.g. to identify the luminaire 131 and/or the lighting device 109 or to identify the luminaire location. Alternatively or in addition, the light output from the luminaire 131 may carry downstream transmission of communication signaling and/or user data. The information or data transmission may involve adjusting or modulating parameters (e.g. intensity, color characteristic, distribution, or the like) of the illumination light output of the light source 110*b* or an aspect of the light output from the display 119*b*. Transmission from the display 119*b* may involve modulation of the backlighting of the particular type of display. Another approach to light based data transmission from the display 119*b* may involve inclusion of a code representing data in a portion of a displayed image, e.g. by modulating individual emitter outputs. The modulation or image coding typically would not be readily apparent to a person in the illuminated area who may observe the luminaire operations but would be detectable by an appropriate receiver. The information transmitted and the modulation or image codding technique may be defined/controlled by configuration data or the like in the memories/storage 125. Alternatively, user data may be received via one of the interfaces 117 and processed in the controller 111 to transmit such received user data via light output from the luminaire 131.

Apparatuses implementing functions like those of configurable lighting device 109 may take various forms. For example, a lighting device 109 may have all of the above hardware components on or within a single hardware platform as shown in FIG. 1B or some components attributed to the lighting device 109 may be separated from the light source 110*b* and the display 119*b* in the luminaire 131 in different somewhat separate units. In a particular example, one set of the hardware components may be separated from one or more instances of the controllable luminaire 131, e.g. such that one host processor system 115 may control several luminaires 131 each at a somewhat separate location wherein one or more of the controlled luminaires 131 are at a location remote from the one host processor system 115. In such an example, a driver system 113 may be located near or included in a combined platform with each luminaire 131. For example, one set of intelligent components, such as the microprocessor 123, may control/drive some number of driver systems 113 and associated controllable luminaires 131. Alternatively, there may be one overall driver system 113 located at or near the host processor system 115 for driving some number of luminaires 131. It also is envisioned that some lighting devices may not include or be coupled to all of the illustrated elements, such as the sensor(s) 121 and the communication interface(s) 117. For convenience, further discussion of the lighting device 109 of FIG. 1B will assume an intelligent implementation of the lighting device 109 that includes at least the illustrated components.

In addition, the luminaire 131 is not size restricted. For example, each luminaire 131 may be of a standard size, e.g. 2-feet by 2-feet (2×2), 2-feet by 4-feet (2×4), or the like, and arranged like tiles for larger area coverage. Alternatively, one luminaire 131 may be a larger area device that covers a wall, a part of a wall, part of a ceiling, an entire ceiling, or some combination of portions or all of a ceiling and wall.

Figure 2A:
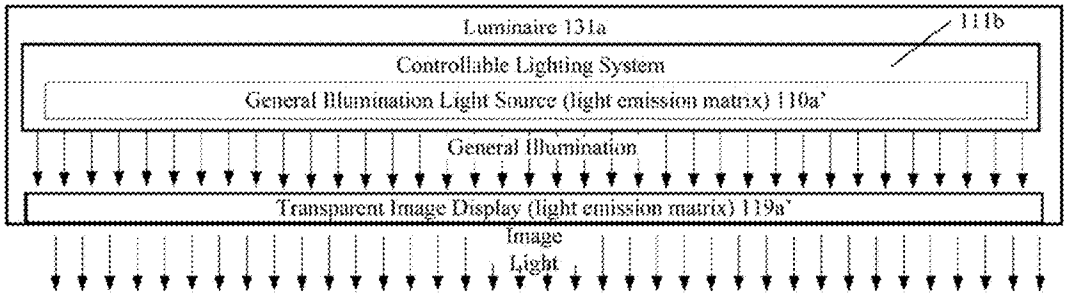
FIGS. 2A to 2C are functional block diagrams of different examples of the luminaire in the device of FIG. 1B, which may support concurrent display image light output and illumination light output.
Figure 2B:
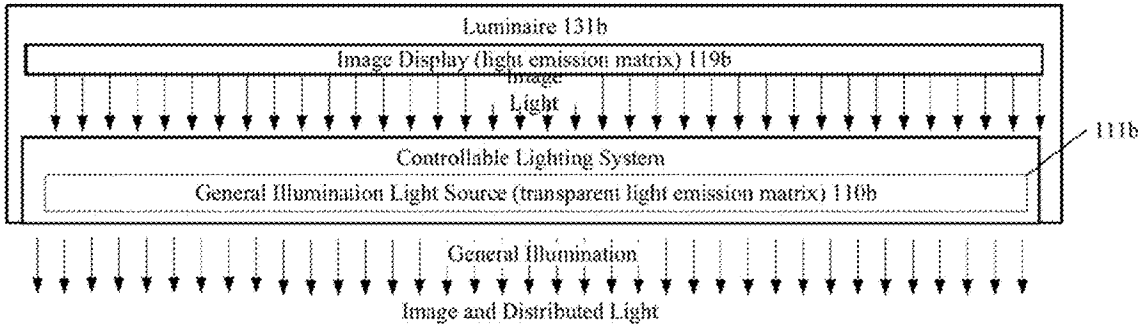
Figure 2C:
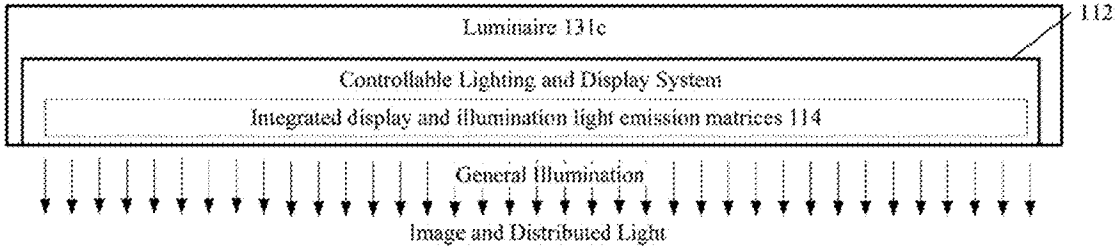

Lighting equipment like that disclosed the example of FIG. 1B, may be used with various implementations of the luminaire 131. Although several examples of luminaire implementations have been briefly discussed above, it may be helpful to consider some examples in more detail. FIGS. 2A-2C provide high level functional illustrations of several general categories of the various implementations of the luminaire 131 of FIG. 1B.

In FIG. 2A, the luminaire 131*a* utilizes a transparent implementation of the display 119*b*', and illumination light from the light source 110*b*' passes through and is combined with the image output light from the transparent image display 119*b*'. In one implementation, the flicker is controlled by controlling frequencies between the display 119*b*' and the light source 110*b'*.

At a high level, the controllable lighting system 111*a* provides general illumination lighting via the light source 110*b*'. The light source 110*b*' is configurable with respect to light intensity. The light from the light source 110*b* typically is white. The color characteristic(s) of the light from the light source 110*b*' also may be controllable. The light source 110*b*' may include or be coupled to output the illumination light via an optical spatial modulator (not shown).

The transparent image display 119*b*' may be either a commercial-off-the-shelf image display device or an enhanced transparent image display device that allows general illumination lighting generated by the light source 110*b*' to pass through. The general illumination lighting alone or in combination with light output from the display illuminates a space in compliance with governmental building codes and/or industry lighting standards. The illumination light source, for example, may support lumen output levels of 200 lumens or higher, with selective dimming capabilities. The transparent image display 119*b*' is configured to present an image. The presented image may be a real scene, a computer generated scene, a single color, a collage of colors, a video stream, or the like.

Examples of transparent displays suitable for application in software configurable lighting devices or luminaires, which use light emission matrices to emit output light of images, are disclosed U.S. patent application Ser. No. 15/198,712, filed Jun. 30, 2016, entitled "enhancements of a Transparent Display to Form a Software Configurable Luminaires" U.S. patent application Ser. No. 15/211,272, filed Jul. 15, 2016, entitled "Multi-Processor System and Operations to Drive Display and Lighting Functions of a Software Configurable Luminaire," U.S. patent application Ser. No. 15/467,333 filed Mar. 23, 2017, entitled "Simultaneous Display and Lighting;" U.S. patent application Ser. No. 15/468,626, filed Mar. 24, 2017 entitled "Simultaneous Wide Lighting Distribution and Display;" and U.S. patent application Ser. No. 15/095,192, filed Apr. 11, 2016, entitled "Luminaire Utilizing a Transparent Organic Light Emitting Device Display," the entire contents all of which are incorporated herein by reference. These incorporated applications also disclose a variety of implementations of a general illumination light source including an illumination light emission matrix co-located the with an image light emission matrix of a transparent display.

The present teachings also apply to luminaires in which the general illumination light source, with the illumination light emission matrix, is transparent with respect to light from the image light emission matrix of the display. FIG. 2B is a high level block diagram illustration of an example of this approach. In such an implementation 13 lb of the luminaire, the illumination light emission matrix may include a transparent emitter matrix of LEDs, OLEDs, etc. similar to any of the examples of the image light emission matrix discussed above, to implement the light source 110*b*. The illumination light emission matrix of the general illumination light source may use a different number of emitters with different spacing between emitters and/or a different type of (e.g. higher intensity and/or different color, output distribution, etc.) specifically tailored to support the general illumination application of the light provided by the light source 110*b*. In one implementation, flicker is controlled by controlling frequencies between the display 119*b* and the light source 110*b*. Although not shown, an optical spatial modulator (or array of modulator cells) may be provided in association with the light source 110*b*.

The luminaire 131*b* also includes an image display 119*b*, including a suitable image light generation matrix. The image display 119*b* may be an off-the-shelf display.

The present teachings also encompass luminaire implementation 131*c* as illustrated in FIG. 2C in which a controllable lighting and display system 112 incorporates functions/emitters of the two matrices together at 114, for example on a single board. In one implementation, flicker is controlled by controlling frequencies between the display 119*c* and the light source 110*c*. Although physically integrated, the emitters are logically operated as two independently controllable emission matrices (one for display and another for general illumination), including for the flicker control strategies discussed herein. Hence, the flicker control strategies may be implemented using the luminaire 131*c* with integrated emission matrices in a manner similar to the examples outlined so far.

Referring back to FIG. 1B, as discussed above, the combined light output from the luminaire output 131*o* is generated via the substantial overlap of available output region of the illumination light matrix with an available output region of the display emission matrix. In one implementation, during operation of generating the combined light output, the host processing system 115 is configured to control the output of one of the image light or the general illumination light to control flicker caused due to interaction of the illumination light matrix with the display emission matrix at the available output region with the substantial overlap. In another implementation, during operation of generating the combined light output, the host processing system 115 is configured to control the output of the both the image light and the general illumination light to control flicker caused due to interaction of the illumination light matrix with the display emission matrix at the available output region with the substantial overlap. The control operation controls the flicker of the illumination light output with aspects of the displayed image light output, e.g. to implement control strategies. In one implementation a type of control strategy relates to mitigation of flicker (reducing or eliminating adverse effects like flicker). In another implementation, a type of control strategy relates to adjusting (e.g. increasing or decreasing the flicker) the flicker. In a further example, a type of control strategy relates to intentionally control flicker for medical uses. Details of the implementations of examples of the control strategies are discussed below relative to FIGS. 3-6. As discussed above in one implementation, the flicker is controlled by mitigating the flicker. In one implementation, the flicker is mitigated via synchronization of frequency of both the display 119*b* and the light source 110*b* such that both the display and the light source 110*b* have the same frequency resulting in the superimposed or combined light (interaction of the light from the display 119*b* with the light from the light source 110*b*) that outputs the same frequency. In one implementation, the synchronization includes to synchronize frequency as such that the frequency of the display 119*b* is same as the frequency of the illumination light source 110*b*. In another implementation, the synchronization includes to synchronize frequency as such that the frequency of the illumination light source 110*b* is same as the frequency of the display 119*b*. In these implementations of synchronizing the frequencies of the illumination light source and the display 119*b*, the frequency of the combined light is above a frequency of a flicker fusion threshold and thus the flicker is not perceived by a human. In one implementation, human perceive flicker at any frequency below the flicker fusion threshold. The flicker fusion threshold is usually below 60 Hz for most people, but some people, with flicker-sensitive eye neurons, can still perceive flicker at frequency above 60 Hz. Therefore, flicker fusion threshold is a human-sensitive number depending on users. In one example, studies showed that the flicker fusion threshold ranges from 50 Hz to 100 Hz.

Figure 3:
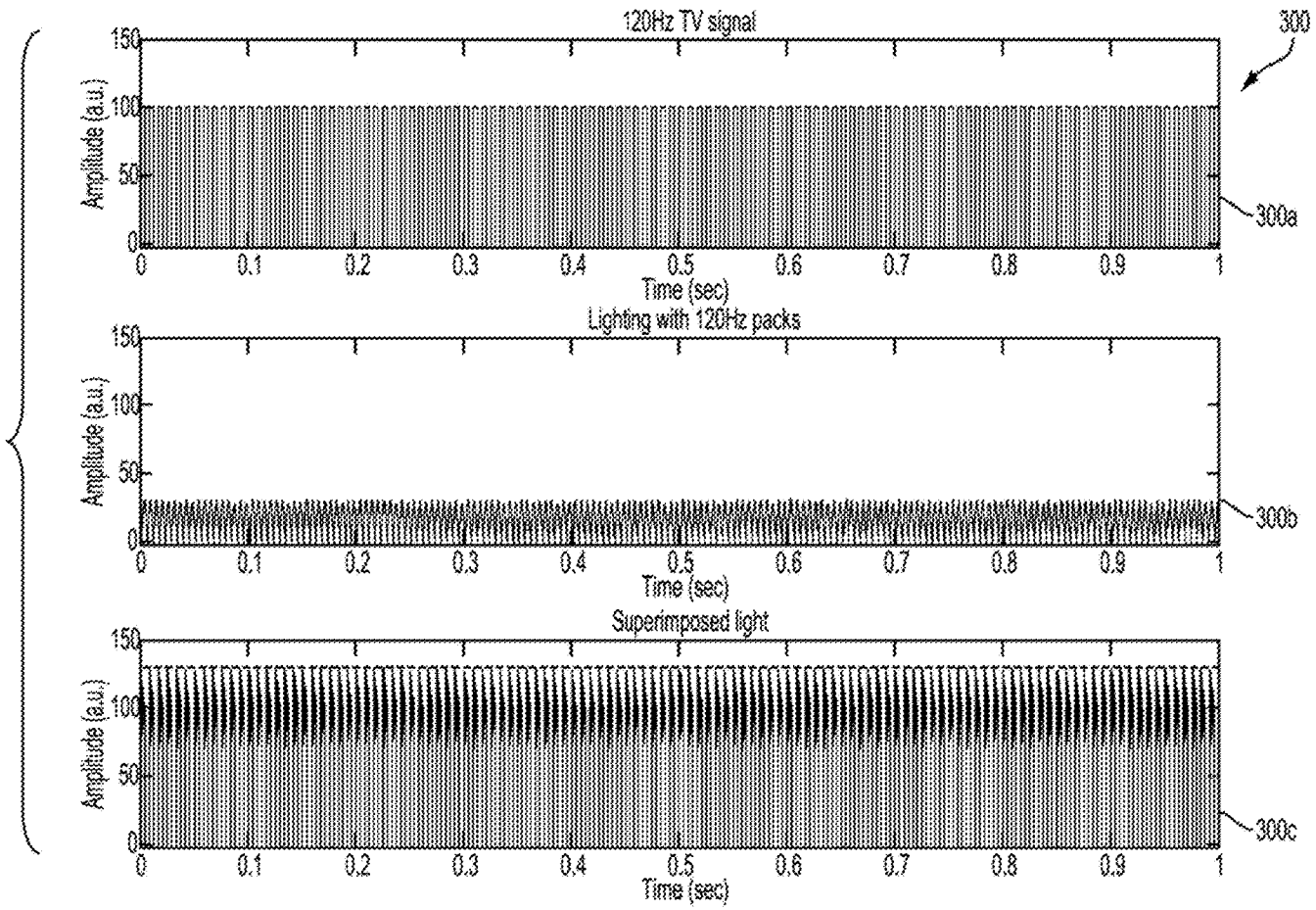
FIG. 3 is a graphical representation of an example of a synchronization as the flicker control strategy applied to the illumination light output and the display image light output of the lighting device of FIG. 1B.

FIG. 3 is a graphical representation 300 of an example of a synchronization as the flicker control strategy applied to the illumination light output and the display image light output of the lighting device of FIG. 1B. In one example, the frequency of the display 119*b* and the frequency of the light source 110*b* are both synchronized to 120 Hz as illustrated in FIG. 3 as the graphical representation 300 of waveforms. The graphical representation 300 illustrate frequency signal waveforms of amplitude (y-axis) of the light signals measured in an arbitrary unit (a.u.) in a time (x-axis) measured in seconds. Such arbitrary unit may include but is not limited to radiant flux (watt), radiant intensity (watt/steradian), irradiance (watt/square meter), human-perceived luminous flux (lumen), luminous intensity (lumen/steradian) etc. The graphical representation 300 illustrate frequency of the image display signal waveforms 300*a*, frequency of the light source signal waveforms 300*b* and the frequency of the combined light signal (linear superposition of the image display signal with the light source signal) waveform 300*c*. As shown, frequency of both the image display signal waveforms 300*a* of the display 119*b* and the light source signal waveforms 300*b* of the light source 110*b* are synchronized to same frequency of 120 Hz resulting in a frequency of combined light signal waveform 300*c* of 120 Hz. Since the frequency of the combined light is at the 120 Hz, which is above a frequency of the flicker fusion threshold, flicker is not perceived by the human.

Figure 3A:
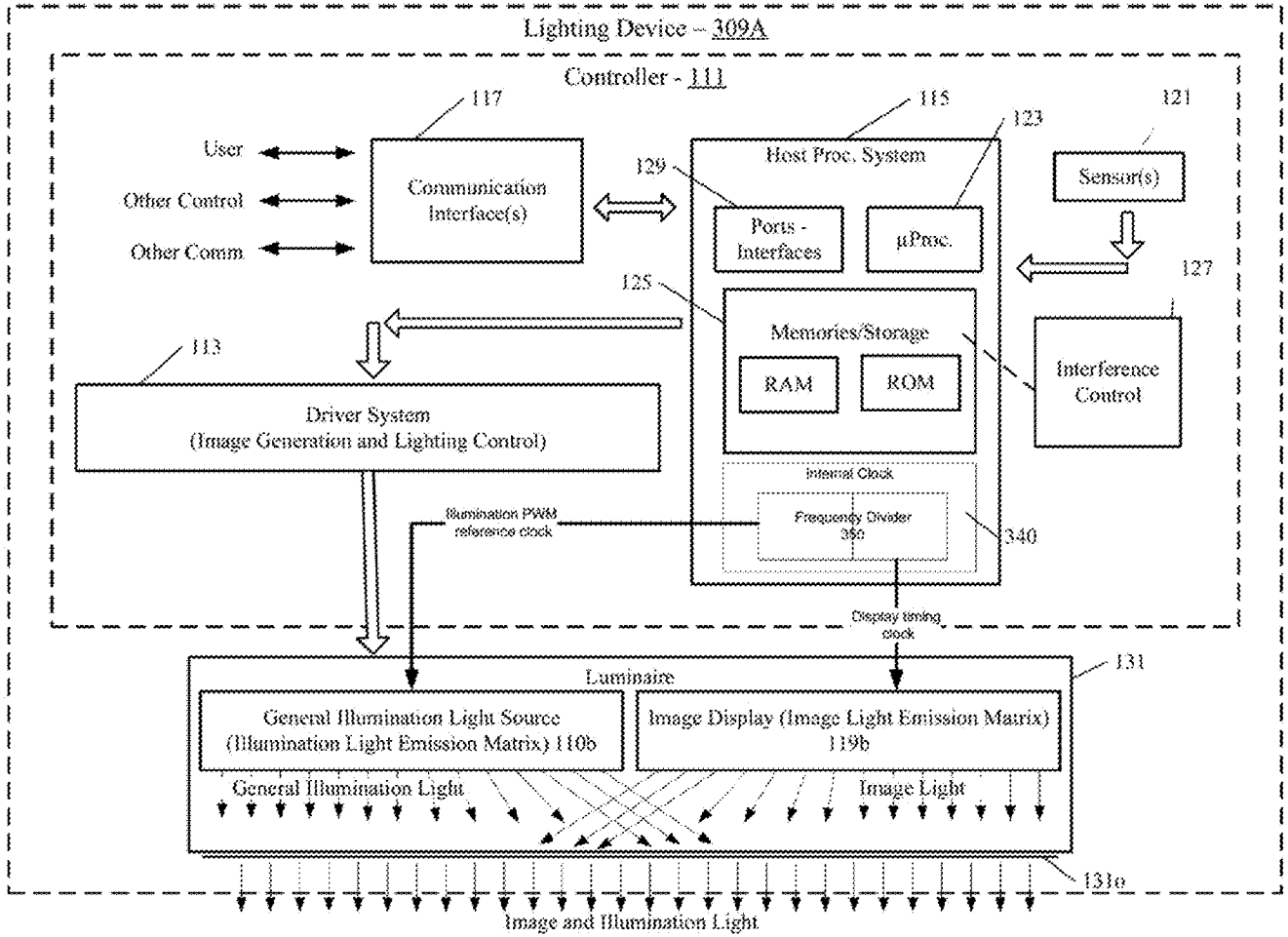
FIG. 3A is an example of a functional block diagram of one implementation of the control element of the lighting device of FIG. 1B configured to implement synchronization as the flicker control strategy.
Figure 3B:
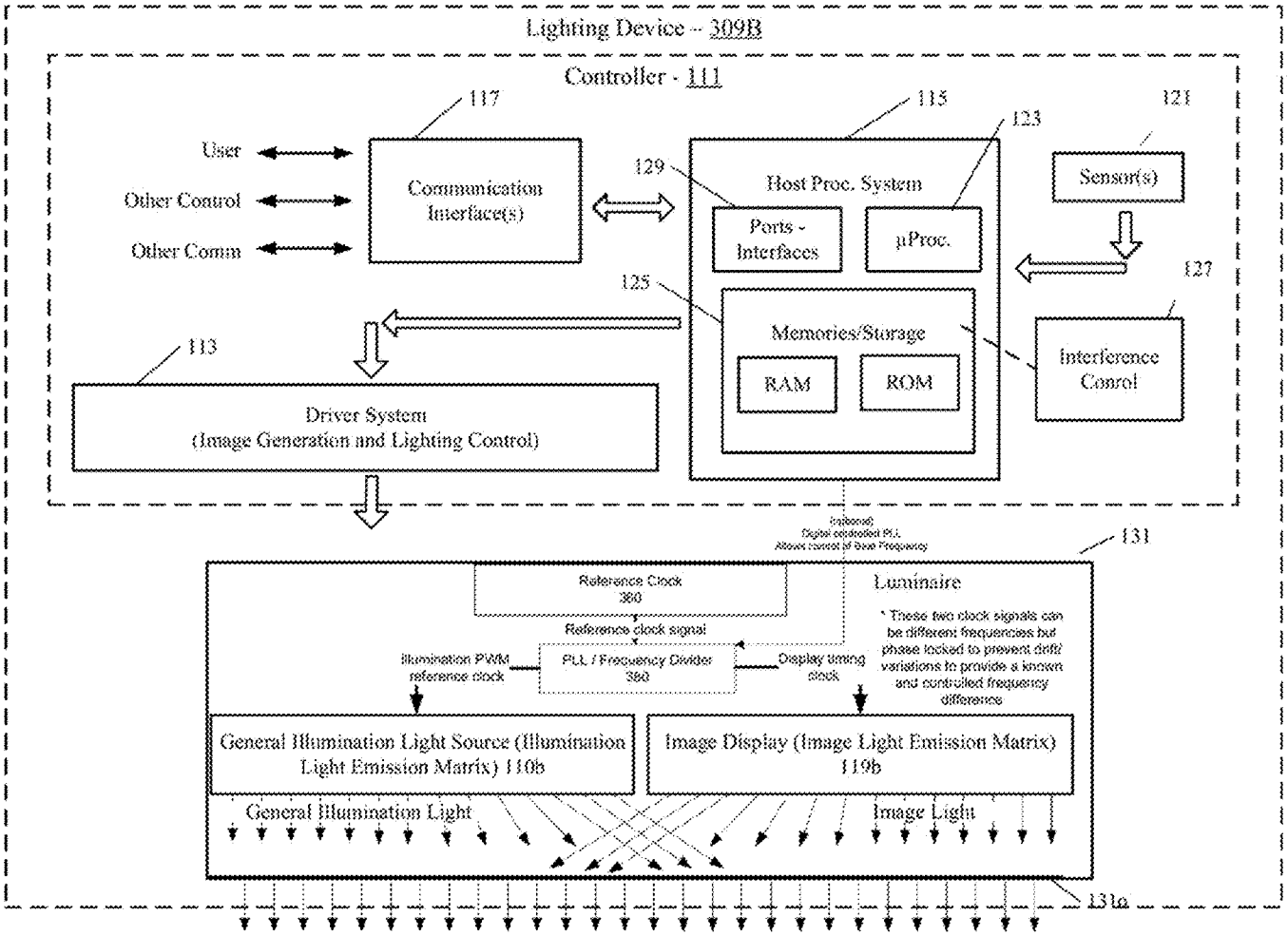
FIG. 3B is an example of a functional block diagram of another implementation of the control element of the lighting device of FIG. 1B configured to implement synchronization as the flicker control strategy.

In one implementation, the synchronization of the frequency is implemented by a clock device in a lighting device 309A and 309B as shown in FIGS. 3A, and 3B respectively described in greater detail below.

FIG. 3A illustrates an example of a functional block diagram of one implementation of the clock device as the control element of the lighting device of FIG. 1B configured to implement synchronization as the flicker control strategy. In one implementation, the lighting device 309A of FIG. 3A is same as the lighting device 109 of FIG. 1B with additional components such as an internal clock 340 embedded in a host processing system 115 of the controller 111 as shown. Although, not shown, in another implementation, the internal clock 340 may be located outside the host processing system 115 yet part of the controller 111. The internal clock 340 functions to provide manipulated timing clocks to the image display 119*b* and the light source 110*b*. Specifically, the internal clock 340 includes an internal frequency divider 350 which functions to manipulate the timing clocks so the timing of a display timing clock (not shown) of the driver system 113 associated with the driving of the display 119*b* with timing of a light source timing clock (not shown) of the driver system 113 associated with the light source 110*b*. For example, the light source timing clock is an illumination pulse width modulation (PWM) reference clock (not shown) in the light source 110*b*, which is set so that 2000 Hz light wave within 300 Hz wave packet is emitted from the light source 110*b*. Simultaneously, the display timing clock (not shown) in the display 119*b* is set to 120 Hz to refresh frame. As such, a beat frequency is 180 Hz (300 Hz-120 Hz), which is above a frequency of the flicker fusion threshold, thus beyond human flicker perception. The beat frequency is equal to the difference in frequency of the two waves that interfere to produce 'optical beats'. As discussed above a flicker frequency threshold is in the range of 50 Hz-100 Hz; accordingly, the frequency divider 350 provides synchronization to mitigate or even eliminate the flicker caused by the combined light, i.e. the interaction of the light from the display 119*b* with the light from the light source 110*b*.

FIG. 3B illustrates an example of a functional block diagram of another implementation of the clock device as the control element of the lighting device of FIG. 1B configured to implement synchronization as the flicker control strategy. In one implementation, the lighting device 309B of FIG. 3B is same as the lighting device 109 of FIG. 1B with additional components such as reference clock 360 and a phase locked loop (PLL) frequency divider 380 coupled to the reference clock 360, both of which are embedded in the luminaire 131 as shown. In one implementation, the reference clock 360 and the PLL frequency divider 380 functions to provide manipulated timing clocks (not shown) to either the image display 119*b* or the illumination light source 110*b*. In one implementation, PLL frequency divider 380 locks a phase of the image display signal waveform 300*a* of the image display 119*b* to a phase of light signal waveform 300*b* of the light source 110*b*, which results in controlled output frequency of the combined light signal waveform 300*c* of the combined light. In one example, display timing clock (not shown) in the display 119*b* is locked to follow illumination PWM reference clock (not shown) in the light source 110*b*. As such, the display refreshes at 120 Hz and the illumination runs precisely at multiple of 120 Hz, e.g. 1200 Hz. In this case, the output frequency of the combined light is still 120 Hz, which is above a frequency of the flicker fusion threshold and thus flicker is not perceived. In another implementation, PLL frequency divider 380 locks a phase of the light signal waveform 300*b* of the light source 110*b* to a phase of image display signal waveform 300*a* of the image display 119*b*, which results in controlled output frequency of the combined light signal waveform 300*c* of the combined light. In another example, illumination PWM reference clock in the light source 110*b* is locked to follow display timing clock. For example, original frequency of illumination PWM reference clock runs at 2000 Hz within a wave packet frequency of 160 Hz. It will result in flicker (40 Hz<flicker fusion frequency 60 Hz) if combined with a display with refresh frequency of 120 Hz. By tuning illumination PWM reference clock such that the illumination clock runs at 2000 Hz within a wave packet frequency of exactly the same 120 Hz, the flicker disappears since now the superposed signal (combined light) runs at 120 Hz as well. In this example, clock of illumination light source 110*b* is altered to follow the constant display clock. Accordingly, the frequency divider 380 provides synchronization to mitigate the flicker caused by the combined light, i.e. the interaction of the light from the display 119*b* with the light from the light source 110*b*.

In one implementation, the flicker is mitigated via a first modulation scheme applied to one of image light output of the display 119*b* or the general illumination light output of the light source 110*b*. Specifically, in one implementation, the processing system 115 is configured to instruct the driver system 113 to utilize the first modulation scheme to modulate outputs of the pixel light sources of the image light emission matrix of the display 119*b*. In another implementation, the processing system 115 is configured to instruct the driver system 113 to utilize the first modulation scheme to modulate outputs of the pixel light sources of the general light emission matrix of the light source 110*b*.

In one implementation, the first modulation scheme is a continuous wave modulation. In one implementation, the frequency of the source 110*b* utilizes the continuous wave modulation to tune lighting brightness. In another implementation, the frequency of the display 119*b* utilizes the continuous wave modulation to tune image brightness. An example of the continuous wave modulation is a direct current (DC) modulation as described below with respect to FIG. 4A and FIG. 4B.

Figure 4A:
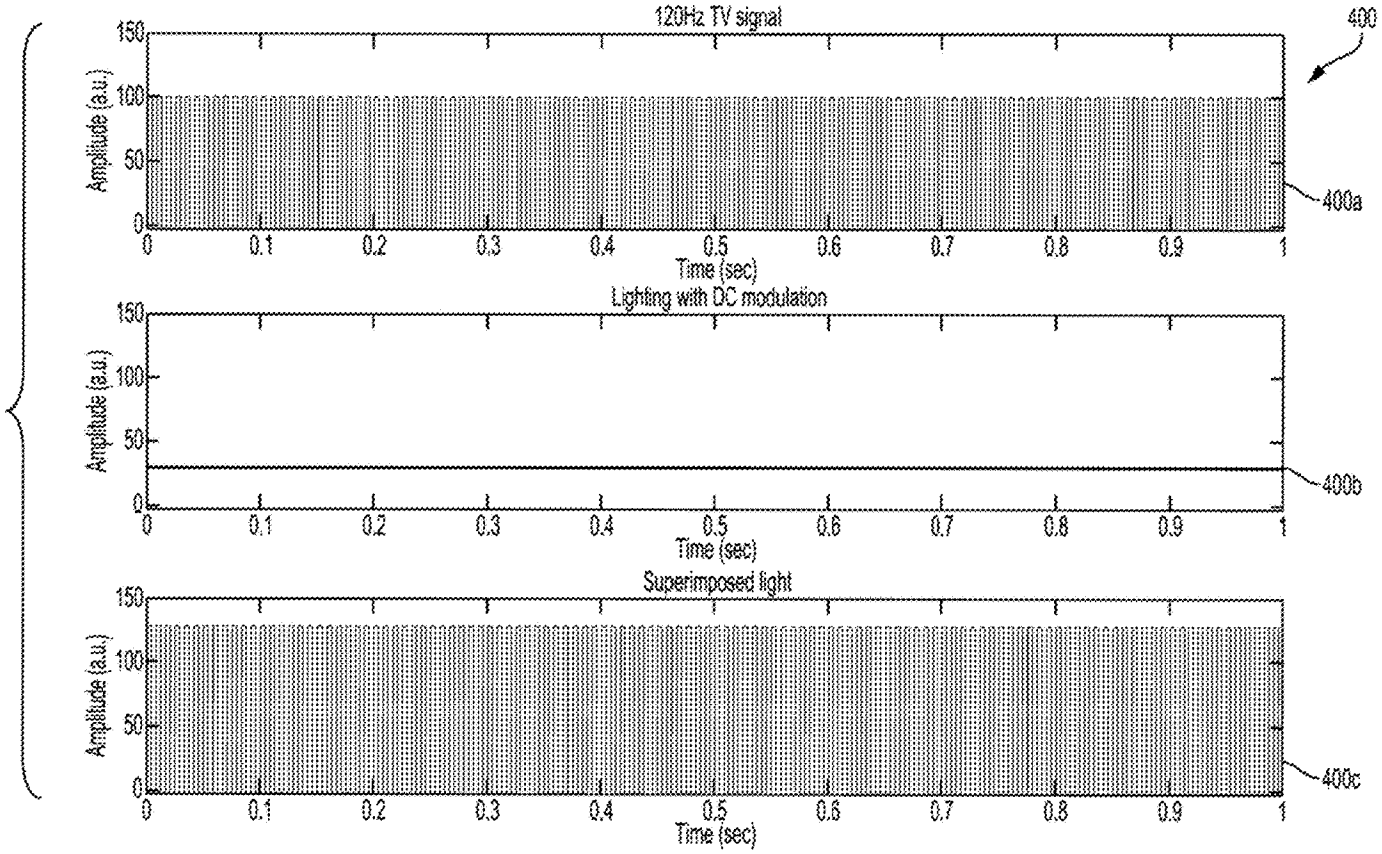
FIG. 4A is a graphical representation of an example of a first implementation of a first modulation scheme as the flicker control strategy applied to illumination light output of the lighting device of FIG. 1B.

FIG. 4A illustrates a graphical representation of an example of the DC modulation applied to general illumination light outputted from the light source 110*b*. As shown is a graphical representation 400 illustrating signal waveforms of amplitude (y-axis) of the light signals measured in an arbitrary unit (a.u.) in a time (x-axis) measured in seconds. Specifically, the graphical representation 400 illustrates image display signal waveforms 400*a*, light source signal waveforms 400*b* and the combined light signal (interaction of the image display signal with the light source signal) waveform 400*c*. As shown, the DC modulation is applied of the general illumination light outputted from the light source 110*b* such that the light source signal waveform 400*b* is a constant dc signal. In one example, the DC modulation is applied by dimming down the light source 110*b* by a lower forward current. In another example, the DC modulation is applied by tuning up the light source 110*b* by a higher forward current. The frequency of image display signal waveforms 400*a* of the display 119*b* is at a frequency of 120 Hz. Accordingly, the output frequency of the combined light signal waveform 400*c* is of 120 Hz (same as the frequency of the light source display 119*b*), which is above a frequency of the flicker fusion threshold; thus flicker is not perceived by the human.

Figure 4B:
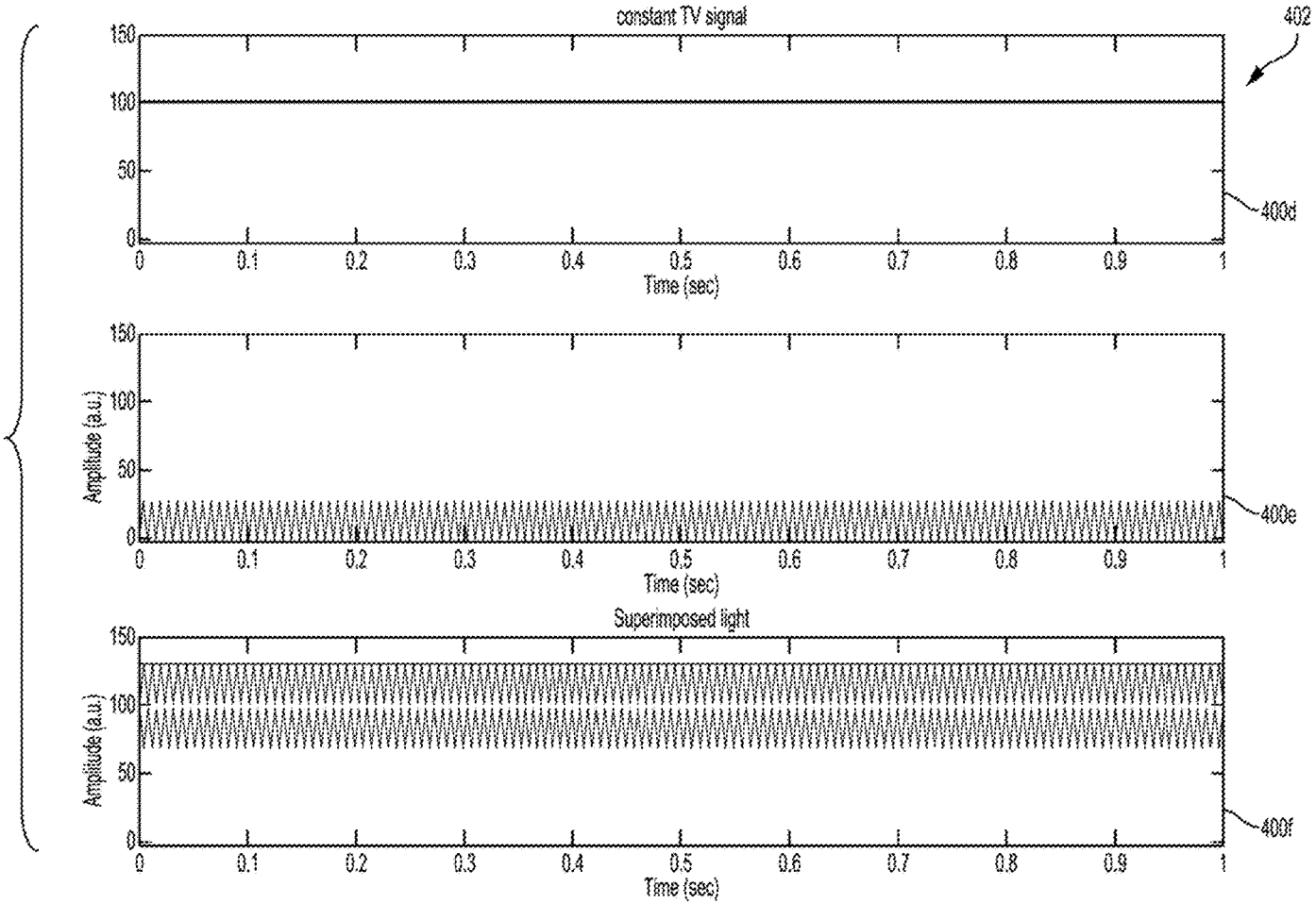
FIG. 4B is a graphical representation of an example of an implementation of the first modulation scheme as the flicker control strategy applied to the display image light output of the lighting device of FIG. 1B.

FIG. 4B illustrates a graphical representation of an example of the DC modulation applied to the image light outputted from the display 119*b*. As shown is a graphical representation 402 illustrating signal waveforms of amplitude (y-axis) of the light signals measured in an arbitrary unit (a.u.) in a time (x-axis) measured in seconds. Specifically, the graphical representation 402 illustrates image display signal waveforms 400*d*, light source signal waveforms 400*e* and the combined light signal (interaction of the image display signal with the light source signal) waveform 400*f*. As shown, the DC modulation is applied to the image light outputted from the display 119*b* such that the image display signal waveform 400*d* is a constant dc signal. The light source signal waveforms 400*e* of the light source 110*b* is at a wave-packet frequency of 130 Hz. Accordingly, the output frequency of the combined light signal waveform 400*f* is of 130 Hz (same as the frequency of the light source 110*b*), which is a frequency above the flicker fusion threshold; thus flicker is not perceived by the human.

In one example, the display 119*b* is an emissive display such that perceived light from an image is directly emitted from a component device that is a light emitter, e.g. LED matrix, OLED display or the like. The display may be similar to those used in televisions or monitors, or the display may provide a different resolution, e.g. lower image definition. In one implementation, the perceived light frequency of an image is modulated by manipulating the component device of the display. In another example, the display 119*b* is a transmissive display such that perceived light from an image comes from transmitted light from a component device such as the light emitter. The light emitter functions as a light gate to control the transmission of a stable backlight, e.g. liquid-crystal (LCD). In one implementation, the perceived light frequency of an image is modulated by manipulating the component device and the backlight. In another further example, the display is a reflective display such that perceived light from an image comes from the reflected light from a reflectivity-tunable device that reflects ambient light e.g. e-ink display. In one implementation, the perceived light frequency of an image is modulated by manipulating the reflectivity-tunable device such that reflective displays usually output constant light signal. In a further example, the display is a transreflective display which is a hybrid of emissive, transmissive and reflective display such that the perceived light frequency of the image is modulated by manipulating the component device and/or the backlight.

As discussed above in one implementation, the flicker is controlled by adjusting the flicker between waveforms of the two types of light output by the luminaire/lighting device. In one example, the flicker is created to be perceived by the human. In one control implementation, the flicker is adjusted to modulate outputs of the pixel light sources of either the image light emission matrix of the display 119*b* or the illumination light emission matrix of the source 110*b*, to either mitigate the flicker (to reduce perceptibility or not be perceived by the human) or to allow the flicker to be perceived by the human or support another intended application of the flicker.

In one implementation, the pixel light sources of the image light emission matrix of the display 119*b* or the illumination source 110*b* are modulated such that the beat frequency is a frequency above the flicker fusion frequency threshold such that the flicker typically is not perceived by the human.

In an alternate implementation, the pixel light sources of the illumination light emission matrix of the illumination source 110*b* or the display 119*b* are modulated such that the beat frequency in the combined light signal falls below a frequency of the flicker fusion frequency threshold and the flicker is perceived by the human. Accordingly, flicker is perceived at the combined light signal. The perceptible flicker, however, may be utilized for desirable purposes, such as to help cure diseases such as Alzheimer's. For such an example, LEDs of one source may be driven at 1000 Hz and LEDs of another source may be driven at 1040 Hz, so as to interfere and create a 40 Hz perceptible flicker perception.

As another example, perceptible flicker may be utilized to intentionally trigger vertigo to alert/evict invaders. For such an example, LEDs of one source may be driven at 1000 Hz and LEDs of another source may be driven 1020 Hz so that 20 Hz flicker can be generated to trigger vertigo.

Different amplitude of the generated flicker also can be controlled by manipulating relative brightness of the two sources independently. Compared to directly driving LEDs of a luminaire at such a low frequency, e.g. 20 or 40 Hz, utilizing beat frequency can give more flexibility to use drivers with a narrow frequency range or with tunable frequency range far from the target frequency.

As discussed above, in one control implementation, the flicker is adjusted. Also, as discussed above, the flicker is adjusted to modulate outputs of the pixel light sources of either the image light emission matric of the display 110*b*119 or the illumination light emission matrix of the source 110*b* to either mitigate, or even eliminate, the flicker or to allow the flicker to be perceived by the human or support another intended application of the flicker. In one implementation, the flicker is adjusted utilizing a second modulation scheme. Specifically, the processing system 115 is configured to instruct the driver system 113 to utilize the second modulation scheme to modulate outputs of the pixel light sources of either the image light emission matrix of the display 119*b* or the illumination light emission matrix of the source 110*b*. In one implementation, the second modulation scheme is a pulse modulation.

An example of the pulse modulation is a frequency shift modulation as described below with respect to FIG. 5A and FIG. 5B respectively.

Figure 5A:
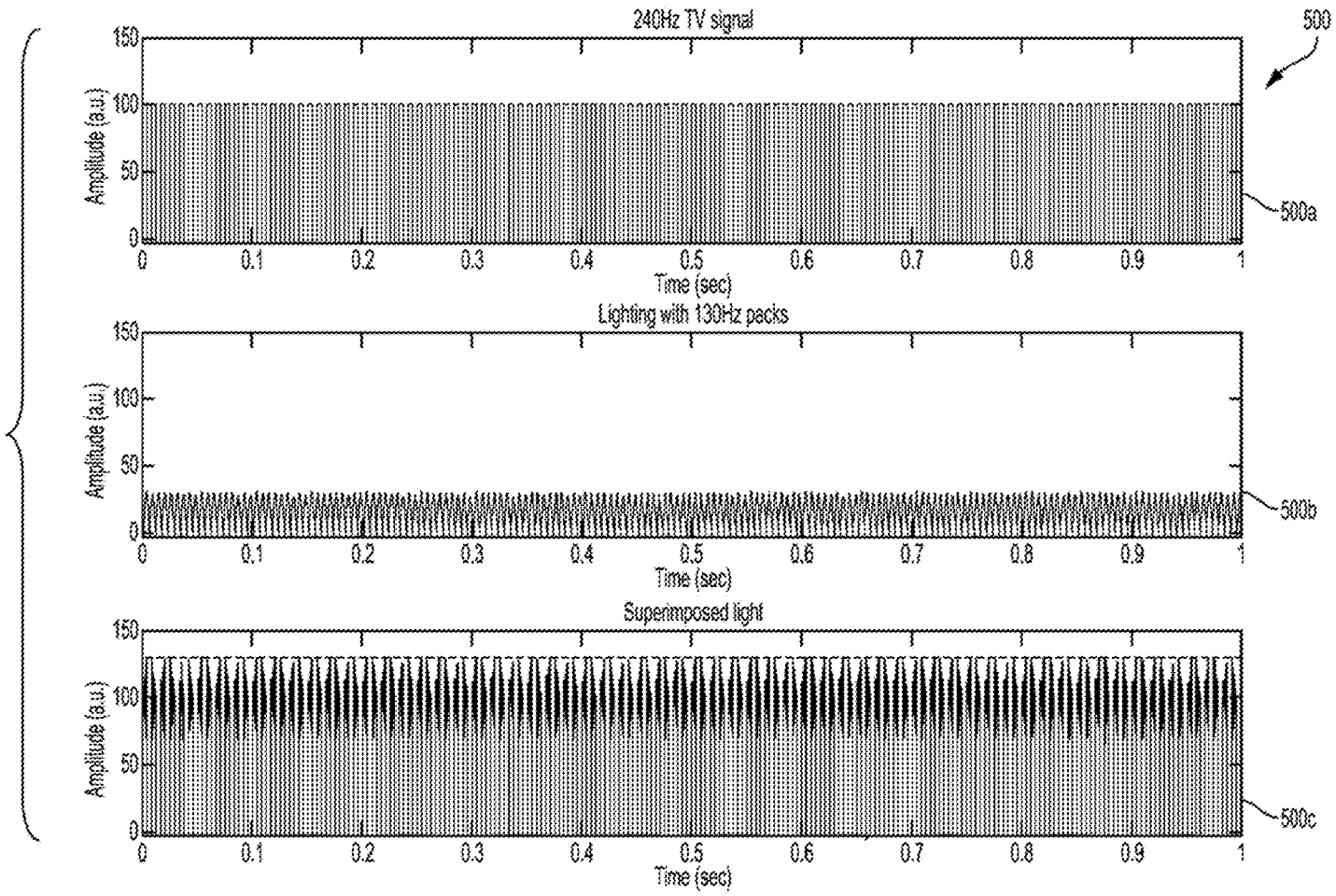
FIG. 5A is a graphical representation of an example of one implementation of a second modulation scheme as the flicker control strategy applied to the display image light output of the lighting device of FIG. 1B.

FIG. 5A illustrates a graphical representation of an example of frequency shift modulation applied to the image light outputted from the display 119*b* of FIG. 1B. As shown is a graphical representation 500 illustrating signal waveforms of amplitude (y-axis) of the light signals measured in an arbitrary unit (a.u.) in a time (x-axis) measured in seconds. Specifically, the graphical representation 500 illustrates image display signal waveforms 500*a*, light source signal waveforms 500*b* and the combined light signal (interaction of the image display signal with the light source signal) waveform 500*c*. In one implementation, the frequency of the image light outputted from the display 119*b* is modified. In one implementation, the frequency of the image light is modified by controlling thin-film transistor (TFT) active matrix charging or discharging time. In one example, a TFT active matrix backplane is a regular pattern of driving circuit units. In another example, a TFT active matrix backplane is a grid of driving circuit units. For each circuit unit, the simplest case includes two TFTs and one capacitor. Tuning gate voltage of one TFT controls amount of electronic flow to charge/discharge the capacitor. The charge stored in the capacitor is later to be used to pump a pixel light emitter. Faster charging/discharging, or equivalently shorter charging/discharging time, means higher frequency of pixel light emitted from pixel light emitter. In one example, the frequency of the image display signal waveform 500*a* is increased from 120 Hz to 240 Hz. The light source signal waveforms 500*b* of the light source 110*b* remains at a frequency of 130 Hz. Accordingly, the beat frequency of the combined light signal 500*c* is of 110*b* Hz, which is above a frequency of the flicker fusion threshold of 50-100 Hz; thus flicker is not perceived by the human.

Figure 5B:
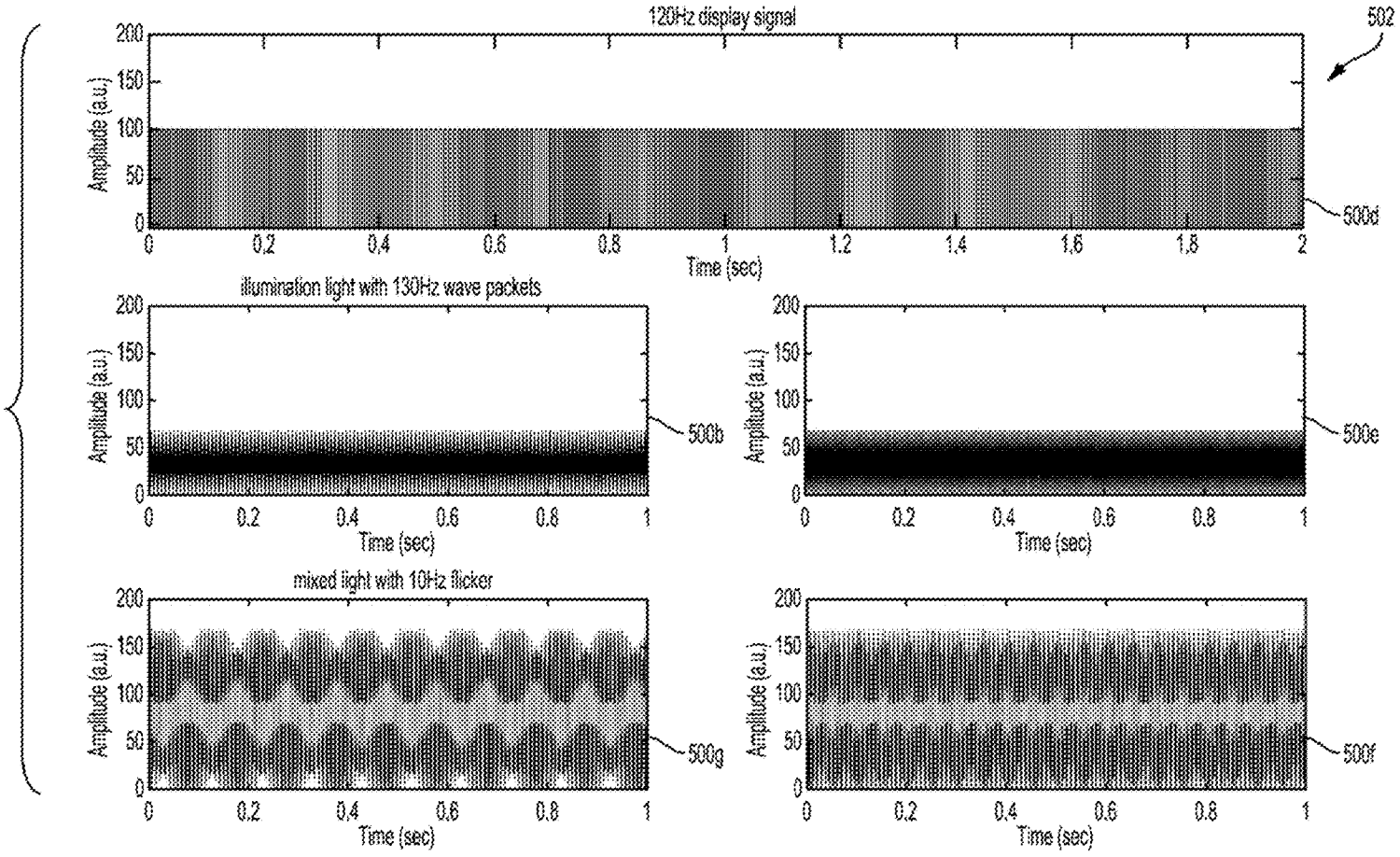
FIG. 5B is a graphical representation of example of another implementation of the second modulation scheme as the flicker control strategy applied to the illumination light output of the lighting device of FIG. 1B.

FIG. 5B illustrates a graphical representation of an example of frequency shift modulation applied to the illumination light outputted from the source 110*b* of FIG. 1B. As shown is a graphical representation 502 illustrating signal waveforms of amplitude (y-axis) of the light signals measured in an arbitrary unit (a.u.) in a time (x-axis) measured in seconds. Specifically, the graphical representation 502 illustrates image display signal waveforms 500*d*, light source signal waveforms 500*b*, light source signal waveform with raised frequency 500*e*, a combined light signal waveform 500*f* with no flicker (interaction of the image display signal waveform 500*d* with the light source signal waveform with the raised frequency 500*e*) and another combined light signal waveform 500*g* with flicker (interaction of the image display signal waveform 500*d* with the light source signal waveform 500*b*). As shown, when the frequency of the light source signal waveform 500*b* is not changed, i.e. remains at 130 Hz, the beat frequency of the combined light signal waveform 500*g* is at 10 Hz, in which case the flicker is perceived by a human. In one implementation, the frequency of the general illumination light outputted from the source 110*b* is modified. In one example, the frequency of the general illumination light outputted from the source 110*b* is modified by tuning up illumination of the internal clock 340 as discussed above with respect to FIG. 3A. In another example, the frequency of the general illumination light outputted from the source 110*b* is modified by tuning up illumination of the reference clock 360 along with the PLL/Frequency divider 380 as discussed above with respect to FIG. 3B. In one example, the frequency of the light source signal waveform is increased from 130 Hz as shown in 500*b* to 220 Hz as shown in light source signal waveform 500*e*. The image display signal waveforms 500*d* remains at a frequency of 120 Hz. As such, the image display signal waveforms 500*d* remains the same and only the light source signal waveform of the illumination source is elevated so the beat frequency is above the threshold. Accordingly, the beat frequency of the combined light signal 500*f* is of 100 Hz, which is above flicker fusion threshold for most people; thus the combined or superimposed 500*f* of display signal 500*d* and illumination signal 500*e* is not perceived as flickers by the human. As discussed above, flicker fusion threshold is not a fixed number but a statistically determined number which varies person by person. It is usually below 60 Hz for most people. Therefore, most people cannot sense flicker if the beat frequency of combined or superimposed light is larger than or equal to 60 Hz. For some people with very good eyes, they can still feel the flicker because their flicker fusion threshold is higher. As such, this is the reason why nowadays TV refresh rate is raised from 60 Hz to 120 Hz such that fewer people can see flicker.

An example of the pulse modulation is an amplitude shift modulation as described below with respect to FIG. 6A and FIG. 6B respectively.

Figure 6A:
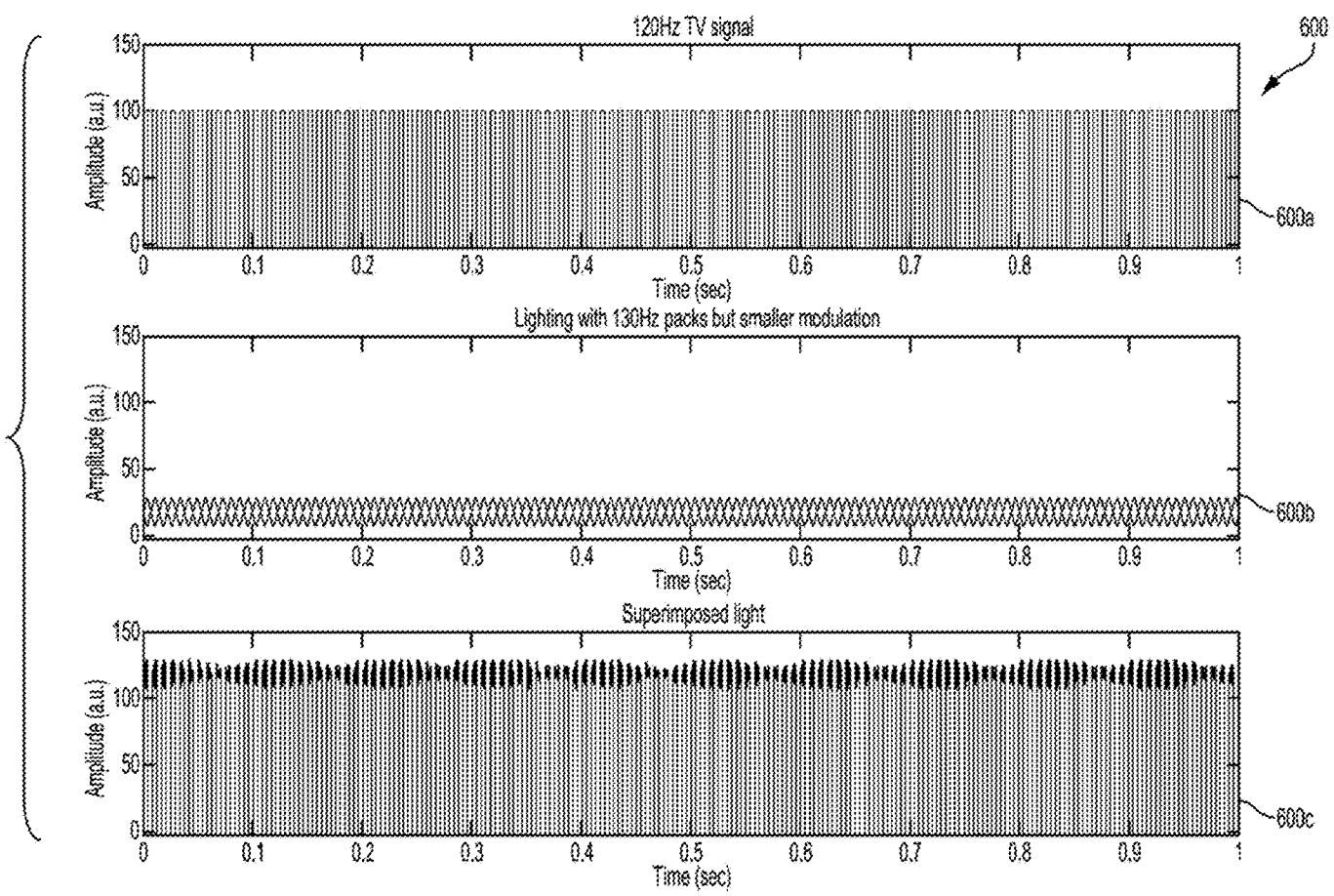
FIG. 6A is a graphical representation of example of another implementation of a second modulation scheme as the flicker control strategy applied to the illumination light output of the lighting device of FIG. 1B.

FIG. 6A illustrates a graphical representation of an example of amplitude shift modulation applied to the general illumination light outputted from the source 110*b* of FIG. 1B. As shown is a graphical representation 600 illustrating signal waveforms of amplitude (y-axis) of the light signals measured in an arbitrary unit (a.u.) in a time (x-axis) measured in seconds. Specifically, the graphical representation 600 illustrates image display signal waveforms 600*a*, light source signal waveforms 600*b* and the combined light signal (interaction of the image display signal with the light source signal) waveform 600*c*. In one implementation, the amplitude of the general illumination light outputted from the source 110*b* is modified. In one implementation, the brightness of a pulse modulated signal is determined by its root-mean square value. For example, a square wave with value 0 and peak value 100 could have same brightness as another wave with valley value 40 and peak value 60. The first wave changes from value 0 to value 100 repeatedly, and its modulation depth is positively related to the difference between peak and valley 100 (100-0). In the other hand, the second wave has a modulation depth positively related to 20 (60-40). In one example, the amplitude of the light source signal is modified with smaller modulation (as illustrated in light source signal waveforms 600*b*), which results in smaller amplitude at the combined light signal (as illustrated in the combined light signal waveform 600*c*). Thus smaller/ shallow modulation depth at the combined light signal 600*cf* alleviates flicker as human experience the combined light signal with less or even no brightness contrast since human perception are in logarithmic scale, i.e. human cannot sense small amplitude difference.

Figure 6B:
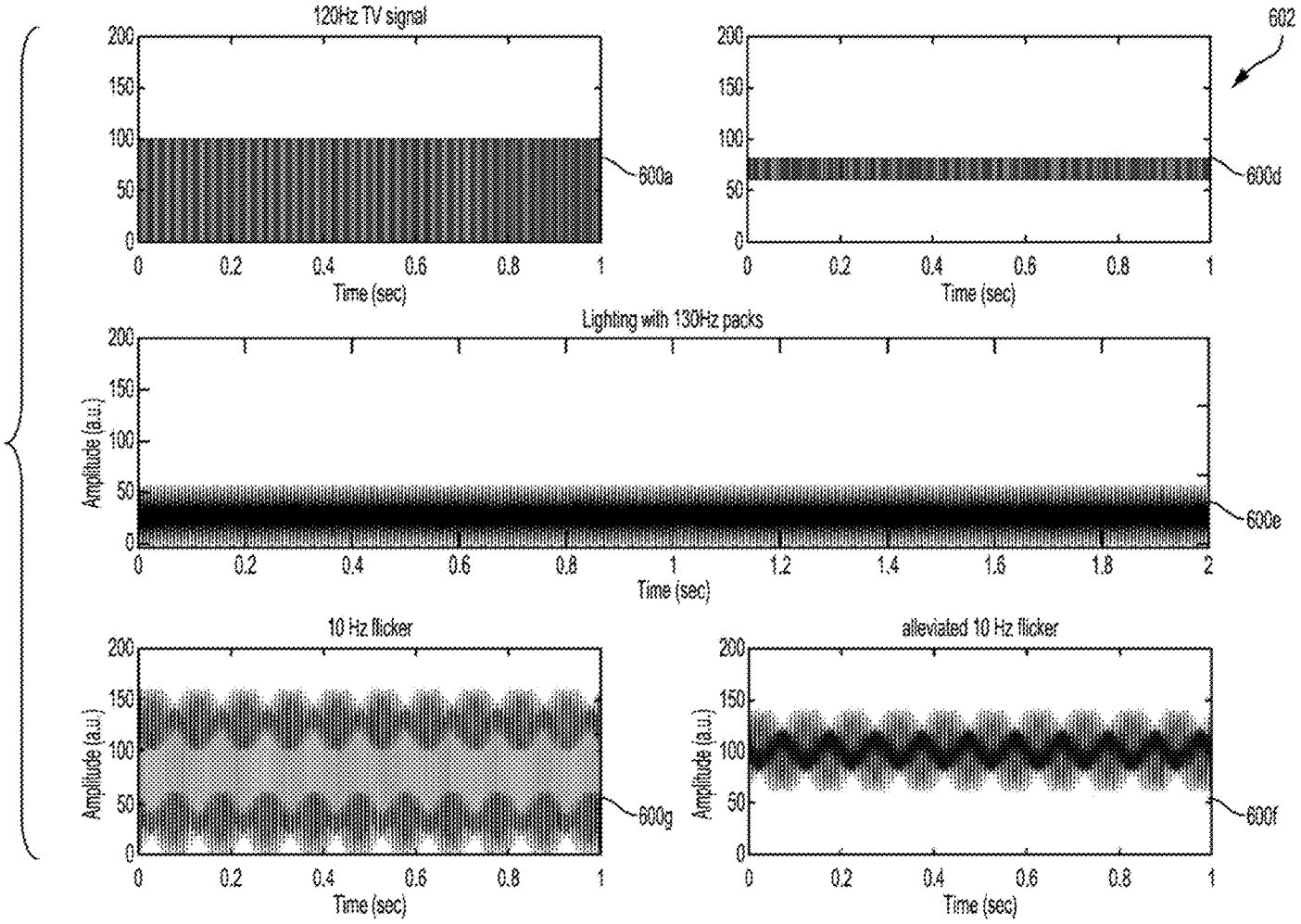
FIG. 6B is a graphical representation of example of another implementation of a second modulation scheme as the flicker control strategy applied to the display image light output of the lighting device of FIG. 1B.

FIG. 6B illustrates a graphical representation of an example of amplitude shift modulation applied to the image light outputted from the image display 119*b* of FIG. 1B. As shown is a graphical representation 602 illustrating signal waveforms of amplitude (y-axis) of the light signals measured in an arbitrary unit (a.u.) in a time (x-axis) measured in seconds. Specifically, the graphical representation 602 illustrates the image display signal waveform 600*a*, image display signal waveforms 600*d* with smaller modulation depth, light source signal waveforms 600*e*, a combined light signal waveform 600*f* (interaction of the image display signal 600*f* with smaller modulation depth with a light source signal 600*e*) and a combined light signal waveform 600*g* (interaction of the image display signal 600*a* with the light source signal 600*e*). As shown, when the amplitude of the image display signal 600*a* is not changed, the flicker is perceived at the beat frequency of 10 Hz. In one implementation, the amplitude of the image light outputted from the display 119*b* is modified. In one example, the amplitude of the image display signal is modified with smaller modulation (as illustrated in image source signal waveforms 600*d*), which results in smaller amplitude at the combined light signal (as illustrated in the combined light signal waveform 600*f*) with alleviated flicker. In one implementation, the amplitude of the image light is modified by a thin-film transistor (TFT) active matrix to control pixel brightness. As discussed above, the transistor controls the amount of electronic flow and the brightness of pixel emitter. Even though, the beat frequency is 10 Hz in which a human can perceive flicker, since the amplitude of the image signal is modified with a smaller modulation depth (i.e. reduced brightness contract) human will not perceive flicker at the superimposed or the combined light waveform 600*f* because sub-peaks have similar intensity with the main peaks (6 sub-peaks and 1 main peak within 0.1 second). As shown in FIG. 6B, there are 10 peaks in one second. Even though, the beat frequency is 10 Hz, this 10 Hz has very small amplitude difference. As shown, in the combined light waveform 600*f* with amplitude shift modulation has smaller bright-dark contrast compared to the combined light waveform 600*g* with no amplitude shift. As such, smaller/shallow modulation depth at the combined light signal alleviates flicker.

Figure 6C:
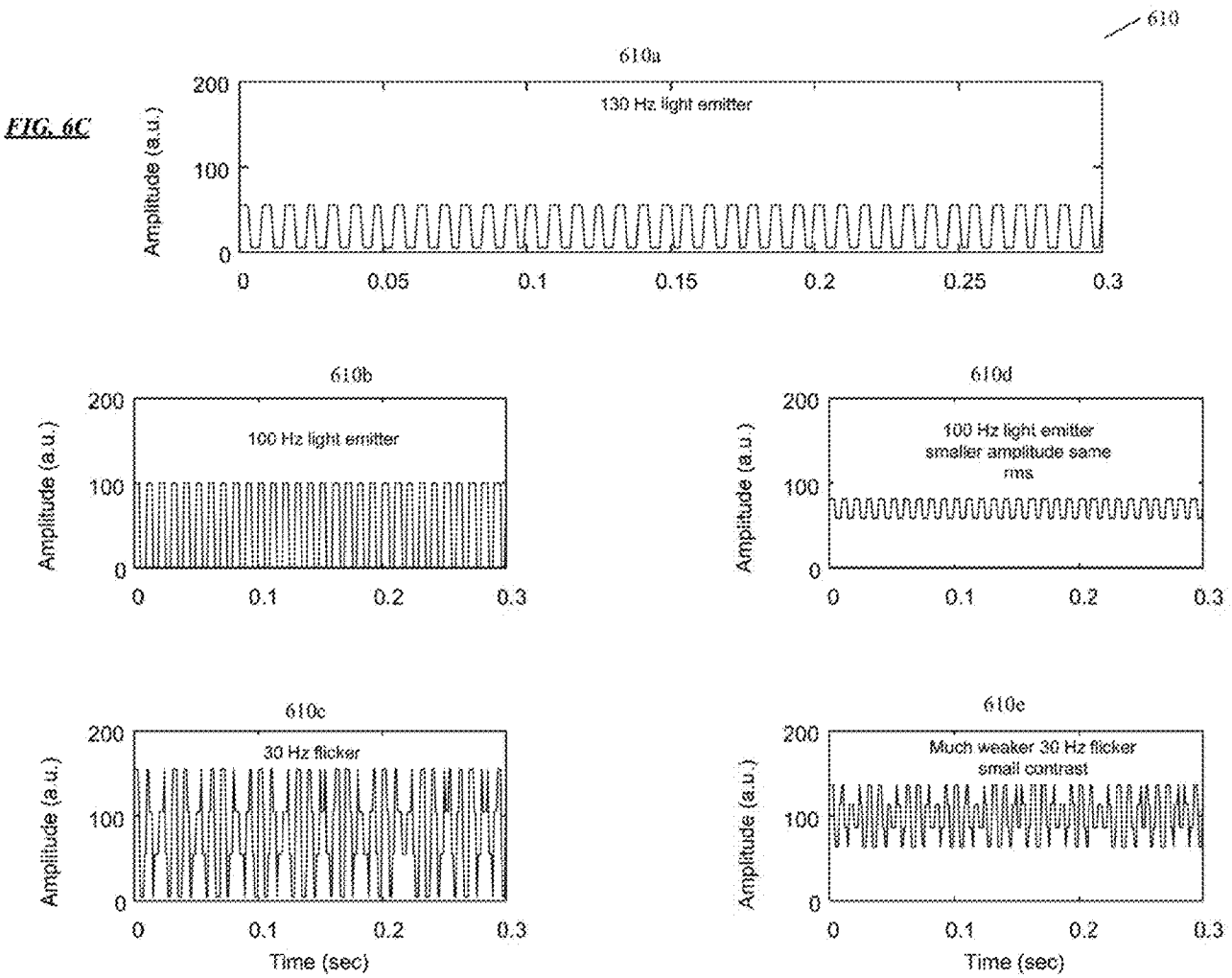
FIG. 6C is a graphical representation of example of another implementation of a second modulation scheme as the flicker control strategy applied to light output of the second light emitter of the lighting device of FIG. 1.

FIG. 6C illustrates a graphical representation of an example of amplitude shift modulation applied to the second light emitter 110 of FIG. 1. As shown is a graphical representation 610 illustrating signal waveforms of amplitude (y-axis) of the light signals measured in an arbitrary unit (a.u.) in a time (x-axis) measured in seconds. Specifically, the graphical representation 610*a* illustrates a first light emitter signal waveform 610*a* from the first light emitter 119 of FIG. 1 and a second light emitter signal waveform 610*b* from the second light emitter 110 of FIG. 1, a combined signal waveform 610*c* (interaction of the first light signal 610*a* with the second light signal 610*b*) a second light emitter 610*d* from the second light emitter 110 with smaller modulation depth, and a combined light signal waveform 600*e* (interaction of first light signal 610*a* and the second light signal 610*d* with smaller modulation depth). As shown, when the amplitude of the second light signal 610*b* is not changed, the flicker is perceived at the beat frequency of 30 Hz. In one implementation, the amplitude of the light outputted from the second light emitter 119 is modified. In one example, the amplitude of second light signal from second light emitter 119 is modified with smaller modulation (as illustrated in the signal waveforms 610*d*), which results in smaller amplitude at the combined light signal (as illustrated in the combined light signal waveform 600*e*) with alleviated flicker. Even though, the beat frequency is 30 Hz in which a human can perceive flicker, since the amplitude of the second light signal is modified with a smaller modulation depth (i.e. reduced brightness contract) human will not perceive flicker at the superimposed or the combined light waveform 600*e* because sub-peaks have similar intensity with the main peaks. Even though, the beat frequency is 30 Hz, this 30 Hz has very small amplitude difference. As such, smaller/shallow modulation depth at the combined light signal alleviates flicker.

Figure 7:
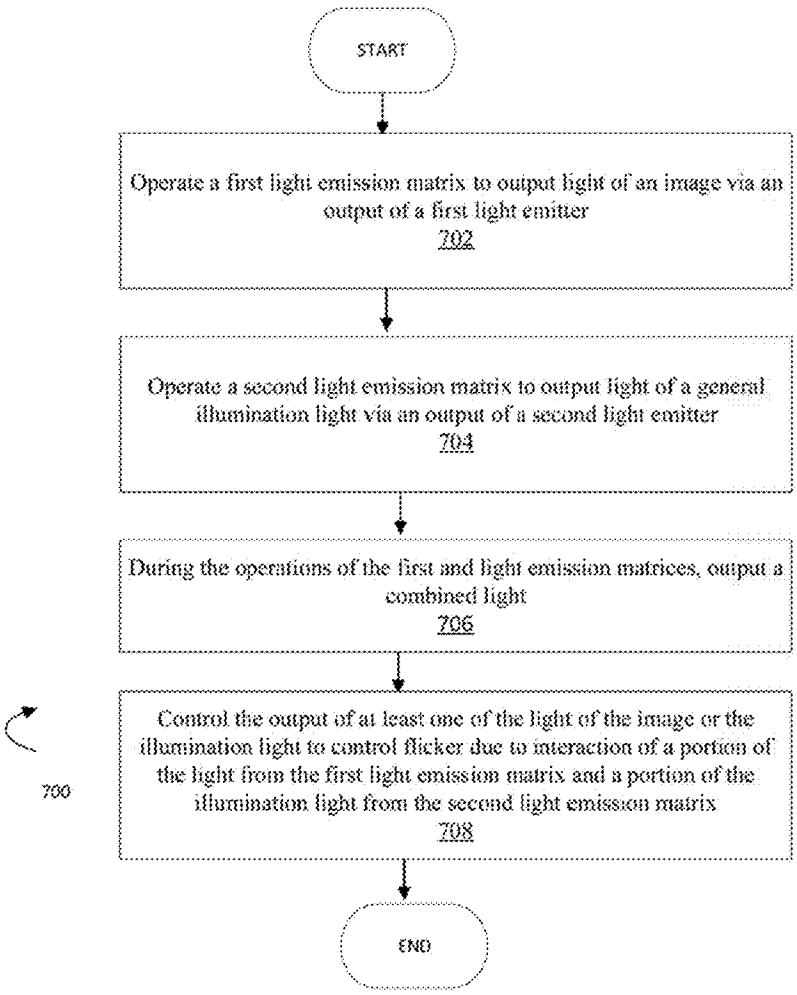
FIG. 7 is high-level flow chart illustration of an example of a method for controlling flicker caused by multiple light sources.

FIG. 7 is high-level flow chart illustration of an example of a method 700 for controlling flicker caused by multiple light sources. In one implementation, the method 700 is implemented by the host processing system 115 and the driver system 113 of FIG. 1.

At block 702, operate a first light emission matrix to output light of an image via an output of a first light emitter. At block 704, operate a second light emission matrix to output illumination light via an output of a second light emitter. In one implementation, the first light emitter is a display and the first light emission matrix is an image light emission matric. In one implementation, the second light emitter is a general illumination light source and the second light emission matrix is an illumination light emission matrix. At block 706, during the operations of the first and light emission matrices, output a combined light. As discussed above, an available output region of the second light emission matrix at least substantially overlaps an available output region of the first light emission matrix, thus the combined light is outputted via the substantial overlap. At block 708, control the output of at least one of the light of the image or the illumination light to control flicker due to interaction of a portion of the light from the first light emitter and a portion of the illumination light from the second light emitter. In one implementation, the substantial overlap occurs when an available output region of the second light emission matrix at least substantially overlaps an available output region of the first light emission matrix. In one implementation, to control the flicker is to mitigate the flicker. In another implementation, to control the flicker is to modify the flicker. In one implementation, the flicker is mitigated via a synchronization of a frequency of an image light output with the illumination light output as described above with respect to FIGS. 3, 3A and 3B. In another implementation, the flicker is mitigated via a continuous modulation scheme. In one example, the continuous modulation scheme is a direct current (DC) modulation. In one implementation, the DC modulation is applied to image light output of one of the first and the second light emitters as described above with respect to FIGS. 4A and 4B. In one implementation, the flicker is mitigated via a frequency shift modulation applied to image light of the first light emitter as described above with respect to FIG. 5A above. In another implementation, the flicker is modified via the frequency shift modulation applied to the illumination light of the second emitter. In one implementation, the flicker is modified via an amplitude shift modulation applied to illumination light of the second light emitter as described above with respect to FIG. 6A above. In one implementation, the flicker is modified via the amplitude shift modulation applied to image light of the first light emitter as described above with respect to FIG. 6B above.

Figure 9:
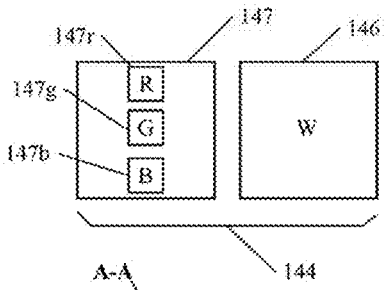
FIG. 9 is an enlarged view of a section of the LED board of the device of FIG. 8, corresponding to the dashed circle A-A in FIG. 8.
Figure 8:
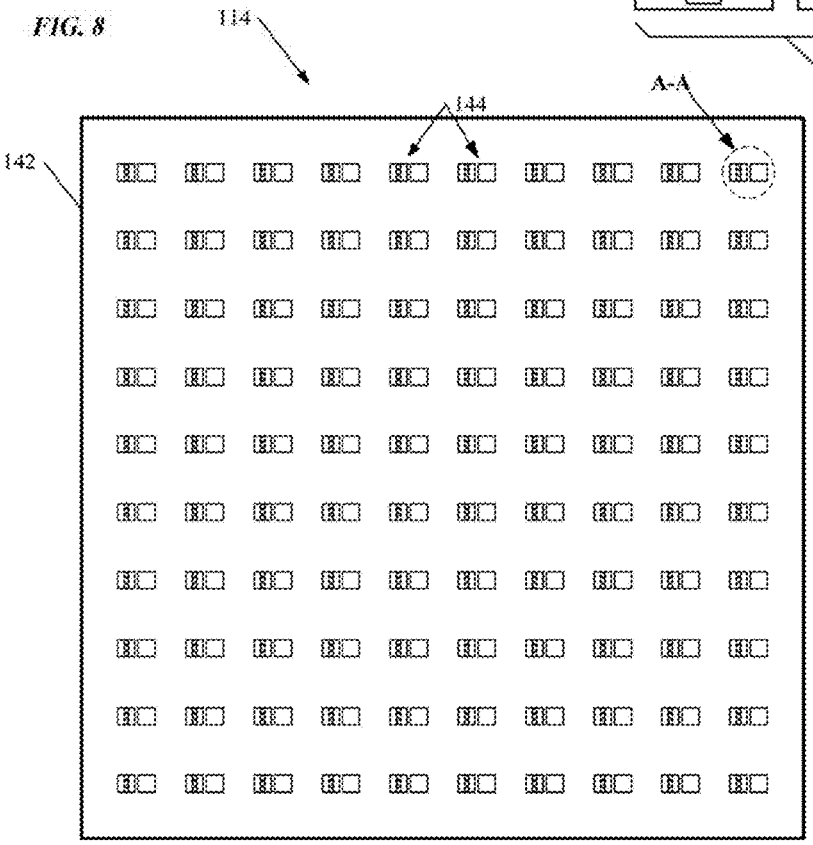
FIG. 8 is a plan view of a light emitting diode (LED) board layout including both a matrix of integral red (R), green (G), blue (B) LED devices for image display light generation and a matrix of higher intensity white (W) LEDs for generating controllable illumination light output for a general lighting application.
Figure 10:
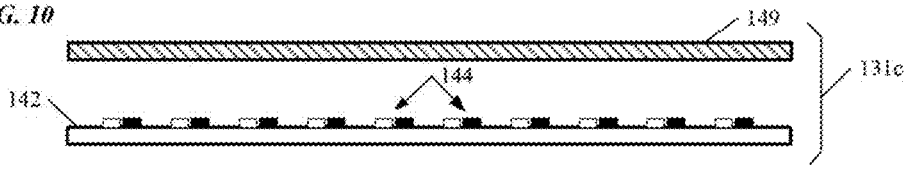
FIG. 10 is an end view of the device of FIG. 8 in combination with a diffuser.

In view of the different in the arrangement of the source and display, it may be helpful to consider an example of an implementation of such an integrated lighting and display system, with respect to FIGS. 8-10.

As shown in FIG. 8, the combined matrix 114 includes an appropriate circuit board 142. A combination of emitters 144 are mounted on the board 142 at each of a number of pixel emission points of the combined matrix 114. As shown in the enlarged example of FIG. 9, the emitters at each such point of the matrix include a white light emitter 146 for illumination light generation and a color and intensity controllable display emitter 147. In the example, the display emitter 146 includes a red emitter (R) 147*r*, a green emitter (G) 147*g* and a blue emitter (B) 147*b*, although additional or alternative color emitters may be provided. In examples, the emitters 146 and 147 may be LED devices. The white illumination light emitter 146 may be a LED of a type commonly used in LED based lighting equipment. The RGB display emitter 147 may be a combined device having the RGB emitters in the same package or on the same chip substrate. The white illumination light emitter 146 may be capable of an output intensity higher than any of the red emitter (R) 147*r*, the green emitter (G) 147*g* and the blue emitter (B) 147*b* and/or higher that the maximum output intensity of overall display emitter 147.

The present example also encompasses arrangements in which one emitter chip or package includes RGBW emitters if the white capability is sufficient for a lighting application. The white emitter 146 could be on the same chip or in the same package as the sub emitters of the display emitter 147. However, because of the higher intensity desired for illumination light generation, and thus the higher amount of generated heat, it may be better to provide the white illumination light emitter separately, as shown. Also, the display emitter 147 may have an output distribution optimized for the display function that is different from the output distribution of an emitter 146 optimized for the illumination function. To provide these distributions, however, corresponding optics may be added. If the display and illumination emitters are Lambertian or emitting in a wide angle, for example, additional space is used for these optics due to etendue limitation, which may limit how close the display and illumination emitters may be placed with respect to each other.

For purposes of the general illumination, the flicker control strategies, the emitters 146 and 147 are controllable through a suitable driver functionality implemented as part of the driver system 113 in the example of FIG. 1. Although integrated into one matrix on the board 142, the emitters 146 and 147 therefore are logically two independent emission matrices for purposes of light generation and control. As a result, the logical matrices may be controlled in essentially the same ways as the matrices of the separate illumination light sources and displays in the earlier examples.

FIG. 10 is a simplified cross-sectional view of a luminaire 131*c* incorporating the board 142 and combined/integrated matrix of emitters at pixel points 144. In addition, the luminaire 131*c* may include a diffuser 149, which helps to homogenize output light for both illumination and image display. As shown in the drawing example, the diffuser 149 may be a separate sheet or layer, e.g. of a suitable white translucent material, adjacent to or formed on output of the luminaire.

The example includes the diffuser 149, but the diffuser is optional. If not provided, the point sources of light, e.g. outputs from the LEDs 146, 147 at points 144, may be visible through the light luminaire output.

For illumination, the diffuser 149 diffuses the illumination light output, which improves uniformity of illumination light output intensity, as may be observed across the output through the luminaire and/or as the illumination light is distributed at a working distance from the luminaire 131*c* (e.g. across a floor or desktop).

For display, the diffuser 149 diffuses the image light from display emitters 147. For some types/resolutions of the display, some degree of diffusion may be tolerable or even helpful. Use of higher resolution data to drive a lower resolution implementation of the display may cause the image output to become pixelated. In some cases, the pixelation may prevent a person from perceiving the intended image on the display. Processing of the image data before application thereof to drive the pixel emitters 147 of the display and/or blurring of the output image by the diffuser 149 effectively blur discrete rectangles or dots of the pixelated image. Such blurring of the pixelated artifacts in the output image may increase an observer's ability to perceive or recognize a low resolution output image. An implementation of such a fuzzy pixels display approach in a system 109 (FIG. 1) with a luminaire such as 131*c* may be implemented by a combination of downsampling of the image data and use of the diffuser 149 over the image display output. A similar diffuser may be used in other luminaire examples. Additional processing of the image data in the digital domain, e.g. Fourier transformation and manipulation in the frequency domain, may be implemented to reduce impact of low resolution image output on some types of display devices.

Figure 11:
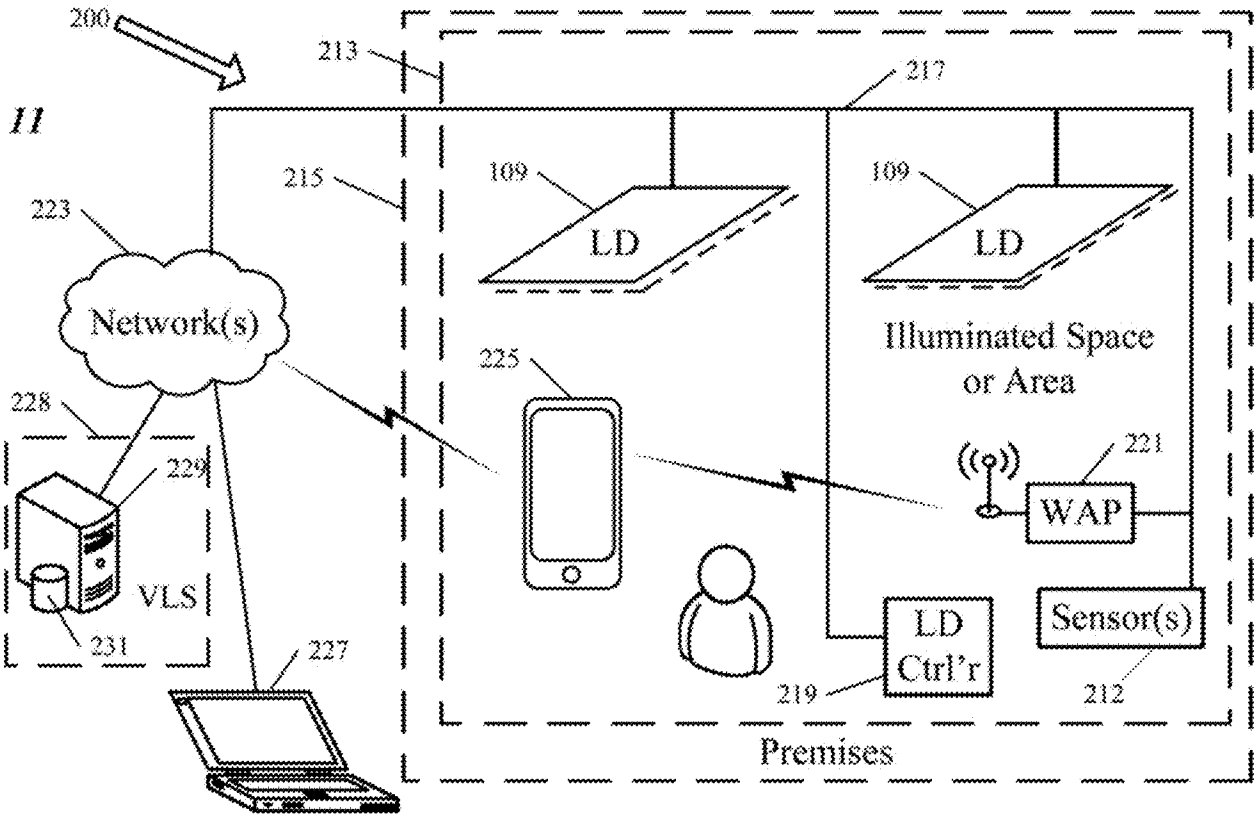
FIG. 11 is a high-level functional block diagram of a system including a number software configurable lighting devices that may display an image and provide general illumination.

It may be helpful to consider a high-level example of a system including software configurable lighting devices 109, with reference to FIG. 11. That drawing illustrates a lighting system 200 for providing configuration or setting information, e.g. based on a user selection, to at least one software configurable lighting device (LD) 109 of any of the types discussed herein, including devices 109 configured to implement one or more of the flicker control strategies. An appropriate flicker control strategy may be based on analysis of received configuration or setting information; or received configuration or setting information may have been adjusted or modified to include additional instructions to enable a lighting device 109 to implement the appropriate flicker control strategy.

The system example 200 shown in the drawing includes a number of such lighting devices (LD) 109. For purposes of discussion of FIG. 11, it is assumed that each software configurable lighting device 109 generally corresponds in structure to the block diagram illustration of a lighting device 109 in FIG. 1, with the illumination light source and display device structured/located to operate as a luminaire 131 as discussed in various other examples above. The example of the lighting system 200 in FIG. 11 also includes a number of other devices or equipment configured and coupled for communication with at least one of the software configurable lighting devices 109.

In the lighting system 200 of FIG. 11, the software configurable lighting devices 109, as well as some other elements of system 200, are installed within a space or area 213 to be illuminated at a premises 215. The premises 215 may be any location or locations serviced for lighting and other purposes by such a system 200 of the type described herein. Lighting devices, such as lighting devices 109, that are installed to provide general illumination lighting in the premises 215 typically comply with governmental building codes (of the respective location of the premises 215) and/or lighting industry standards. Most of the examples discussed below focus on indoor building installations, for convenience, although the system may be readily adapted to outdoor lighting. Hence, the example of lighting system 200 provides configurable lighting (illumination and display) and possibly other services in a number of service areas in or associated with a building, such as various rooms, hallways, corridors or storage areas of a building and an outdoor area associated with a building. Any building forming or at the premises 215, for example, may be an individual or multi-resident dwelling or may provide space for one or more enterprises and/or any combination of residential and enterprise facilities. A premises 215 may include any number of such buildings, and in a multi-building scenario the premises may include outdoor spaces and lighting in areas between and around the buildings, e.g. in a campus (academic or business) configuration.

The system elements, in a system like lighting system 200 of FIG. 11, may include any number of software configurable lighting devices 109 as well as one or more lighting controllers 219. The lighting controller 219 may be an automated device for controlling lighting, e.g. based on timing conditions; and/or the lighting controller 219 may provide a user interface. Lighting controller 219 may be configured to provide control of lighting related operations (e.g., ON/OFF, intensity or brightness, color characteristic(s), etc.) of any one or more of the lighting devices 109. A lighting controller 219, for example, may take the form of a switch, a dimmer, or a smart control panel including a graphical, speech-based and/or touch-based user interface, depending on the functions to be controlled through device 219.

A lighting device 109 may include a sensor (as in FIG. 6). In the example, other system elements may also include one or more standalone implementations of sensors 212. Sensors, for example, may be used to control lighting functions in response to various detected conditions, such as occupancy or ambient light. Other examples of sensors include light or temperature feedback sensors that detect conditions of or produced by one or more of the lighting devices. If separately provided, the sensors may be implemented in intelligent standalone system elements such as shown at 212 in the drawing. Alternatively, sensors may be incorporated in one of the other system elements, such as one or more of the lighting devices 109 and/or the lighting controller 219.

The on-premises system elements 109, 212, 219, in a system like the system 200 of FIG. 11, are coupled to and communicate via a data network 217 at the premises 215. The data network 217 may be a wireless network, a cable network, a fiber network, a free-space optical network, etc.; although the example shows connection lines as may be used in a hard-wired or fiber type network implementation. The data network 217 in the example also includes a wireless access point (WAP) 221 to support communications of wireless equipment at the premises. For example, the WAP 221 and network 217 may enable a user terminal for a user to control operations of any lighting device 109 at the premises 213. Such a user terminal is depicted in FIG. 11, for example, as a mobile device 225 within premises 215, although any appropriate user terminal may be utilized. However, the ability to control operations of a lighting device 109 may not be limited to a user terminal accessing data network 217 via WAP 221 or other on-premises point of access to the network 217. Alternatively, or in addition, a user terminal such as laptop 227 located outside premises 215, for example, may provide the ability to control operations of one or more lighting devices 109 via one or more other networks 223 and the on-premises data network 217. Network(s) 223 may include, for example, a local area network (LAN), a metropolitan area network (MAN), a wide area network (WAN) or some other private or public network, such as the Internet.

Data network communications allow installation of configuration files or streaming of configuration instructions/data to the lighting devices 109 at the premises. Such data communications also may allow selection among installed configuration files in any lighting device 109 that stores more than one such file. In another example, a memory device, such as a secure digital (SD) card or flash drive, containing configuration data may be connected to one or more of the on-premises system elements 109, 212 or 219 in a system like system 200 of FIG. 11.

For lighting operations, the system elements (109, 212 and/or 219) for a given service area 213 are coupled together for network communication with each other through data communication media to form a portion of a physical data communication network. Similar elements in other service areas of the premises are coupled together for network communication with each other through data communication media to form one or more other portions of the physical data communication network at the premises 215. The various portions of the network in the service areas in turn are coupled together to form a data communication network at the premises, for example to form a LAN or the like, as generally represented by network 217 in FIG. 11. Such data communication media may be wired and/or wireless, e.g. cable or fiber Ethernet, Wi-Fi, Bluetooth, or cellular short range mesh. In many installations, there may be one overall data communication network 217 at the premises. However, for larger premises and/or premises that may actually encompass somewhat separate physical locations, the premises-wide network 217 may actually be built of somewhat separate but interconnected physical networks utilizing similar or different data communication media.

System 200 also includes server 229 and database 231 accessible to a processor of server 229. Although FIG. 11 depicts server 229 as located outside premises 215 and accessible via network(s) 223, this is only for simplicity and no such requirement exists. Alternatively, server 229 may be located within premises 215 and accessible via network 217. In still another alternative example, server 229 may be located within any one or more system element(s), such as lighting device 109, lighting controller 219 or sensor 212. Similarly, although FIG. 11 depicts database 231 as physically proximate server 229, this is only for simplicity and no such requirement exists. Instead, database 231 may be located physically disparate or otherwise separated from server 29 and logically accessible by server 29, for example via network 17.

Database 231 in this example is a collection of configuration information files for use in conjunction with one or more of software configurable lighting devices 109 in premises 215 and/or similar devices 109 of the same or other users in other areas or at other premises. The image and lighting configuration information may be combined into one configuration file for each overall luminaire output performance configuration or setting, or each image and each set of light configuration information may be in separate files. Data for implementing associated flicker control also may be included in configuration files with image and lighting control data or contained in other files in the database 231. For general illumination lighting, a setting or configuration file may specify intensity performance at various dimming levels and/or one or more color characteristics for general illumination; and such configuration information may include distribution settings for a lighting device luminaire 131 that also incorporates spatial optical modulation capabilities for the illumination light output. The general illumination lighting control data in the setting or configuration file may also specify aspects of flicker control, for example, particular general illumination LEDs to operate and/or color or intensity of the LEDs selected for operation.

The image data for use in driving the display may be in the same or a separate file. One option is to generate relevant control instructions for communication with the image data, for example, as part of or associated with the file containing the image data. For example, for a control strategy like one of the examples shown in FIGS. 2-6, the data associated with the image data may specify one or more of size, shape or location of output of a particular image on the display (corresponding to a particular part of the area of the luminaire output 131*o*).

The software configurable lighting device 109 is configured to set illumination light generation parameters of the light source and possibly set modulation parameters for any spatial modulator in accordance with a selected configuration information file. For example, a selected configuration information file from the database 31 may enable a software configurable lighting device 109 to achieve a performance corresponding to a selected type or of existing hardware luminaire for a general illumination application or any other arbitrarily designed/selected general illumination performance. Thus, the combination of server 229 and database 231 may represent a "virtual luminaire store" (VLS) 228 or a repository of available configurations that enable a software configurable lighting device 109 to selectively function like any one of a number of real or imagined luminaires represented by the available illumination configurations.

It should be noted that the output performance parameters for general illumination need not always or precisely correspond optically to an emulated luminaire. For a catalog luminaire selection example, the light output parameters may represent those of one physical luminaire selected for its light characteristics whereas the distribution performance parameters (if the lighting device incorporates spatial optical modulation) may be those of a different physical luminaire or even an independently determined performance intended to achieve a desired illumination effect in area 213. The light distribution performance, for example, may conform to or approximate that of a physical luminaire or may be an artificial construct for a luminaire not ever built or offered for sale in the real world.

It should also be noted that, while various examples describe loading a single configuration information file onto a software configurable lighting device 109, this is only for simplicity. Lighting device 109 may receive one, two or more configuration information files and each received file may be stored within lighting device 109. In such a situation, a software configurable lighting device 109 may, at various times, operate in accordance with configuration information in any selected one of multiple stored files, e.g. operate in accordance with first configuration information during daylight hours and in accordance with second configuration information during nighttime hours or in accordance with different file selections from a user operator at different times for different intended uses of the space 213. Alternatively, a software configurable lighting device 109 may only store a single configuration information file. In this single file alternative situation, the software configurable lighting device 109 may still operate in accordance with various different configuration information, but only after receipt of a corresponding configuration information file which replaces any previously received file(s). In a further alternative, some or all of the relevant configuration information may be streamed to a lighting device more or less in real time.

Display images may be selected through the store 28 or obtained from other image sources.

Figure 14:
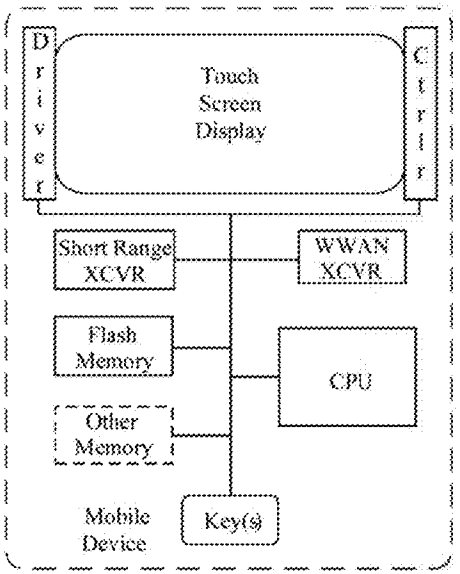
FIG. 14 is a simplified functional block diagram of a mobile device, as an alternate example of a user terminal device, for possible communication with a software configurable lighting device.
Figure 12:
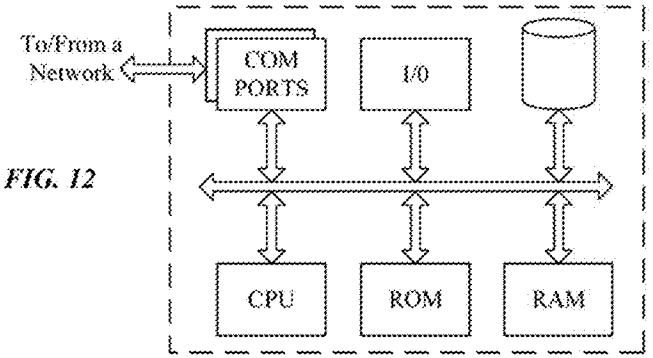
FIG. 12 is a simplified functional block diagram of a computer that may be configured as a host or server, for example, to supply communicate with a software configurable lighting device, such as that of FIG. 1, e.g., in a system like that of FIG. 11.
Figure 13:
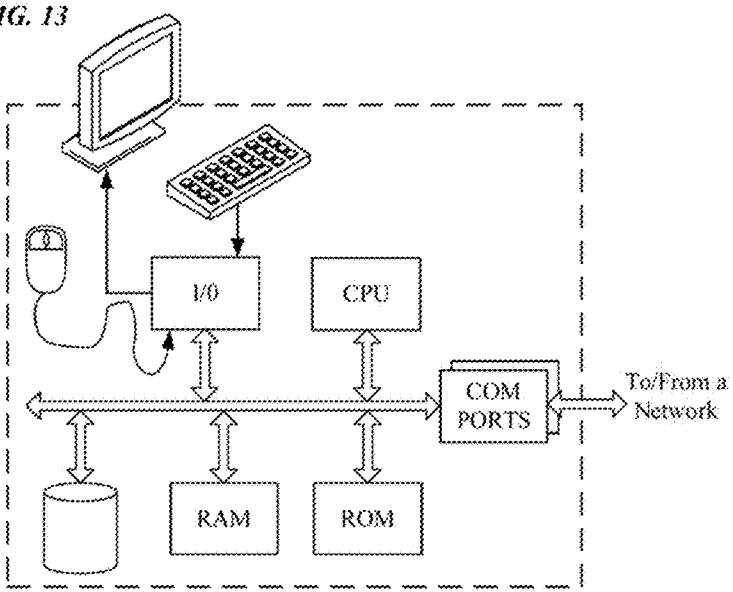
FIG. 13 is a simplified functional block diagram of a personal computer or other similar user terminal device, which may communicate with a software configurable lighting device.

As shown by the above discussion of FIG. 11, although many intelligent processing functions are implemented in lighting device, at least some functions may be implemented via communication with general purpose computers or other general purpose user terminal devices, although special purpose devices may be used. FIGS. 12 to 14 provide functional block diagram illustrations of exemplary general purpose hardware platforms that may be used in the system 200.

FIG. 11 illustrates a network or host computer platform, as may typically be used to generate, send and/or receive lighting control commands, configuration files and/or images and to access networks and devices external to the lighting device 109, for example, to implement the server 229 and/or the database 231 of the virtual luminaire store 228 of FIG. 11. FIG. 13 depicts a computer with user interface communication elements, such as terminal 227 as shown in FIG. 11, although the computer of FIG. 13 may also act as a server if appropriately programmed. The block diagram of a hardware platform of FIG. 14 represents an example of a mobile device, such as a tablet computer, smartphone or the like with a network interface to a wireless link, which may alternatively serve as a user terminal device for providing a user communication with a lighting device, such as device 109, or with a server. It is believed that those skilled in the art are familiar with the structure, programming and general operation of such computer equipment and as a result the drawings should be self-explanatory.

A server (see e.g. FIG. 12), for example, includes a data communication interface for packet data communication via the particular type of available network. The server also includes a central processing unit (CPU), in the form of one or more processors, for executing program instructions. The server platform typically includes an internal communication bus, program storage and data storage for various data files to be processed and/or communicated by the server, although the server often receives programming and data via network communications. In general, the hardware elements, operating systems and programming languages of such servers may be conventional in nature. Of course, the server functions may be implemented in a distributed fashion on a number of similar platforms, to distribute the processing load. A server, such as that shown in FIG. 12, may be accessible or have access to a lighting device 109 via the communication interfaces 117 of the lighting device 109. For example, the server may respond to a user request for an image and/or a configuration information file to send the requested information to a communication interface 117 of the lighting device 109. The information of a configuration information file may be used to configure a software configurable lighting device, such as lighting device 109, to set light output parameters comprising: (1) light intensity, (2) light color characteristic, (3) spatial modulation, or (4) image display in accordance with the received information. The received information may be used at the lighting device to implement an flicker control strategy of the type described above relative to FIGS. 1-6; or the analysis steps may be performed in advance at the server or another computer, in which case, the received information may provide illumination setting data and possibly display control data to implement a particular flicker control strategy.

A computer type user terminal device, such as a desktop or laptop type personal computer (PC), similarly includes a data communication interface CPU, main memory (such as a random access memory (RAM)) and one or more disc drives or other mass storage devices for storing user data and the various executable programs (see FIG. 13). A mobile device (see FIG. 14) type user terminal may include similar elements, but will typically use smaller components that also require less power, to facilitate implementation in a portable form factor. The example of FIG. 14 includes a wireless wide area network (WWAN) transceiver (XCVR) such as a 3G or 4G cellular network transceiver as well as a short range wireless transceiver such as a Bluetooth, WiFi, and/or ultra-wide band transceiver for wireless local area network (WLAN) communication. The computer hardware platform of FIG. 12 and the terminal computer platform of FIG. 13 are shown by way of example as using a RAM type main memory and a hard disk drive for mass storage of data and programming, whereas the mobile device of FIG. 14 includes a flash memory and may include other miniature memory devices. It may be noted, however, that more modern computer architectures, particularly for portable usage, are equipped with semiconductor memory only.

The various types of user terminal devices will also include various user input and output elements. A computer, for example, may include a keyboard and a cursor control/selection device such as a mouse, trackball, joystick or touchpad; and a display for visual outputs (see FIG. 13). The mobile device example in FIG. 14 uses a touchscreen type display, where the display is controlled by a display driver, and user touching of the screen is detected by a touch sense controller (Ctrlr). In general, the hardware elements, operating systems and programming languages of such computer and/or mobile user terminal devices also are conventional in nature.

The user device of FIG. 13 and the mobile device of FIG. 14 may also interact with the lighting device 109 in order to enhance the user experience. For example, third party applications stored as programs on such terminal equipment may correspond to programming 127 at the device 109, to allow the user to manipulate control parameters of a software configurable lighting device 109, such as image display and general illumination lighting settings. The user may also have some options to provide input to the flicker control strategy, e.g. selection of a particular area of the luminaire output for the display to output the light of the particular image.

The lighting device 109 in other examples is configured to perform visual light communication. Because of the beam steering (or steering) capability, the data speed and bandwidth can have an increased range. For example, beam steering and shaping provides the capability to increase the signal-to-noise ratio (SNR), which improves the visual light communication (VLC). Since the visible light is the carrier of the information, the amount of data and the distance the information may be sent may be increased by focusing the light. Beam steering allows directional control of light and that allows for concentrated power, which can be a requirement for providing highly concentrated light to a sensor. In other examples, the lighting device 109 is configured with programming that enables the lighting device 109 to "learn" behavior. For example, based on prior user interactions with the platform, the lighting device 109 will be able to use artificial intelligence algorithms stored in memory 125 to predict future user behavior with respect to a space.

As also outlined above, aspects of the techniques for operation of a software configurable lighting device 109 with the combinatorial luminaire 131 and any system interaction therewith, may involve some programming, e.g. programming of the lighting device 109 or any server or terminal device in communication with the lighting device. For example, the mobile device of FIG. 14 and the user device of FIG. 13 may interact with a server, such as the server of FIG. 12, to obtain configuration information that may be delivered to a software configurable lighting device 109. Subsequently, the mobile device of FIG. 14 and/or the user device of FIG. 13 may execute programming that permits the respective devices to interact with the software configurable lighting device 109 to provide control commands such as the ON/OFF command, an image selection or a performance command, such as dim or change beam steering angle or beam shape focus. The processor 123 of the software configurable lighting device 109 in turn runs its flicker control 127 to control the display device and the light source of the luminaire 131, in accordance with one or more received images, in accordance with received light performance settings from the configuration information and in accordance with the appropriate flicker control strategy.

Program or data aspects of the technology discussed above therefore may be thought of as "products" or "articles of manufacture" typically in the form of executable programming code (software or firmware) or data that is carried on or embodied in a type of machine readable medium. At least one medium, for example, may carry image data and an illumination light setting. Programming or control data also is embodied in the at least one medium. This programming or control data is configured to implement control of operation of a general illumination light source 110*b* of the luminaire 131 when outputting general illumination light responsive to the setting while the display 119*b* of the luminaire 131 is concurrently outputting light of an image based on the image data. The control operation controls flicker of the illumination light output with aspects of the displayed image light output, for example, in one or more of the ways discussed above relative to FIGS. 1-6.

"Storage" type media include any or all of the tangible memory of lighting devices, computers, user terminal devices, intelligent standalone sensors, processors or the like, or associated modules thereof, such as various volatile or non-volatile semiconductor memories, tape drives, disk drives and the like, which non-transitory devices may provide storage at any time for executable software or firmware programming and/or any relevant data or information. All or portions of the programming and/or configuration data may at times be communicated through the Internet or various other telecommunication networks. Such communications, for example, may enable loading of the data or programming from one computer or processor into another, for example, from a management server or host computer of the lighting system service provider into any of the lighting devices 109, sensors 212, user interface devices 219, 225 or 227, other non-lighting-system devices, etc. Thus, another type of media that may bear the programming or data elements includes optical, electrical and electromagnetic waves, such as used across physical interfaces between local devices, through wired and optical landline networks and over various air-links. The physical elements that carry such waves, such as wired or wireless links, optical links or the like, also may be considered as media bearing the software. As used herein, unless restricted to non-transitory, tangible or "storage" media, terms such as computer or machine "readable medium" refer to any medium that participates in providing instructions to a processor for execution.

The image data, light setting data, and programming or data for flicker control may be embodied in at least one machine readable medium, one or more of which may be non-transitory. For example, if downloaded to a lighting device 109, the image data, light setting data, and programming or data for flicker control could be stored in a hardware device that serves as the memory/storage 125 of the host processor system 115. The memory/storage 125 is an example of a non-transitory type of media. By way of another example, at times, executable operational programming, including programming and/or data for the flicker control strategy, may reside in the memory/storage 125, while actual image data and/or associated general illumination light setting data is transmitted in real time via a network medium. Flicker control data may reside in memory 125 or be streamed over the network medium. In these later examples, the received streaming data would be stored temporarily at the lighting device, e.g. in memory serving a buffer, for manipulation by a processor in the lighting device 109. The signal(s) on the network would be transitory in nature. However, the buffer memory and any memory or registers internal to the processor memory, or any hardware storage device used by the server to maintain the database or prepare selected data for transmission over the network would be additional examples of non-transitory media.

The light with beat frequency, whether above or below the flicker fusion threshold, also may be used in other intentional applications. For example, the beat frequency may be controlled in different luminaires to provide beacon identification of the luminaires via the visible light outputs. Currently beaconing is used to identify luminaires and is achieved by radio frequency technology like Bluetooth, ultra-wide-band, Wi-Fi, etc. or by visible like communication (VLC) by modulating a light source in a manner detectable by a rolling shutter camera of a cell phone or the like. Knowing the physical location of luminaire helps locate the user as well, for example, based on the known luminaire location and calculating the relative distance from luminaire based on signal strength and/or angle of arrival. Superimposed light with beat frequency arising from two set of LEDs with distinct frequencies may also be used in such beaconing applications. For example, assume that one luminaire has two LED based sources output light waveforms at two distinct frequencies, this luminaire can generate high-frequency light that human cannot perceive but can be detected by photo detectors that are commonly used in smartphones.

By way of a simple example, in an area having three luminaires I, II, and III, each with two sets A and B of LEDs may operate as in the following table.

| | Luminaire | | |
|---|---|---|---|
| | I | II | III |
| Set A LEDs (Hz) | 2000 | 2100 | 2300 |
| Set B LEDs (Hz) | 2100 | 2300 | 2600 |
| Superimposed/Combined light with beat frequency(Hz) | 100 | 200 | 300 |

Figure 15:
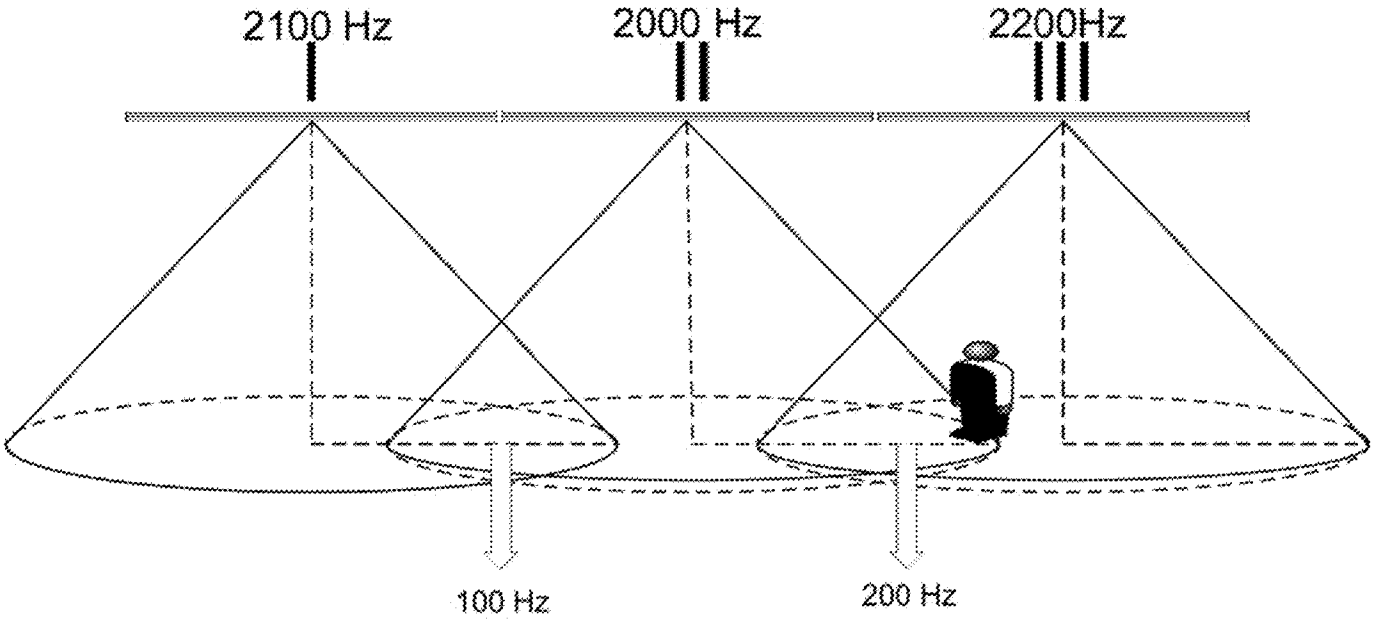
FIG. 15 illustrates an example of beat frequency beaconing in a system with three luminaires.

FIG. 15 illustrates an example of beat frequency beaconing in a system with three Luminaires I, II and III. As shown in FIG. 15, Luminaires I, II, and III is set to run at the frequency of 2100 Hz, 2000 Hz, and 2200 Hz, respectively. Light in overlap zone between I and II Luminaires has a beat frequency of 100 Hz while light in overlap zone between Luminaries II and III has a beat frequency of 200 Hz. In one implementation, the physical locations of the Luminaires I, II and III are determined by sensing and analyzing relative strength of light with different frequencies. Accordingly, in such case, the user's experience, without flickering, is noted with the same lighting properties such as correlated-color-temperature (CCT) and uniform illuminance. In this implementation, a human eye cannot detect flicker but a photo detector can detect flicker with the beat frequency of 100, 200 and 300. Additionally, the relative distance between two Luminaries can be determined. A silicon photo detector can easily detect light frequencies at hundreds of Hz. In the example, the smartphone can identify each luminaire when visible to the photo detector, from detection of the beat frequency of the light output. Then, from the received signal strength of different frequency signals and known location(s) of the identified luminaire(s), the smartphone or a computer in communication with the smartphone can determine physical location of the smartphone.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," "includes," "including," or any other variation thereof, are intended to cover a non-exclusive inclusion, such that a process, method, article, or apparatus that comprises or includes a list of elements or steps does not include only those elements or steps but may include other elements or steps not expressly listed or inherent to such process, method, article, or apparatus. An element preceded by "a" or "an" does not, without further constraints, preclude the existence of additional identical elements in the process, method, article, or apparatus that comprises the element.

Unless otherwise stated, any and all measurements, values, ratings, positions, magnitudes, sizes, and other specifications that are set forth in this specification, including in the claims that follow, are approximate, not exact. Such amounts are intended to have a reasonable range that is consistent with the functions to which they relate and with what is customary in the art to which they pertain. For example, unless expressly stated otherwise, a parameter value or the like may vary by as much as ±10% from the stated amount.

In addition, in the foregoing Detailed Description, it can be seen that various features are grouped together in various examples for the purpose of streamlining the disclosure. This method of disclosure is not to be interpreted as reflecting an intention that the claimed examples require more features than are expressly recited in each claim. Rather, as the following claims reflect, the subject matter to be protected lies in less than all features of any single disclosed example. Thus the following claims are hereby incorporated into the Detailed Description, with each claim standing on its own as a separately claimed subject matter.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present concepts.

What is claimed is:

1. A lighting device, comprising:

a luminaire comprising:

a first light emitter comprising a first light emission matrix configured to output a first light from the first emission matrix;

a second light emitter comprising a second light emission matrix configured to output a second light from the second light emission matrix, wherein the first light emitter is oriented with the second light emitter such that an available output region of the second light emission matrix at least substantially overlaps an available output region of the first light emission matrix, and a driver system coupled to the luminaire to control the first and the second light outputs generated by the first and second light emission matrices;

a processing system coupled to the driver system, wherein the processing system is configured to operate the first light emitter and the second light emitter via the driver system to implement functions, including functions to:

operate the first light emission matrix to output the first light via an output of the first light emitter;

operate the second light emission matrix to output the second light via an output of the second light emitter; and during the operations of the first and second light emission matrices to output a combined light via the substantial overlap, to control the output of at least one of the first light or the second light to control flicker due to interaction of a portion of the first light from the first light emission matrix and a portion of the second light from the second light emission matrix.

2. The lighting device of claim 1, wherein the first light emitter is co-located with the second light emitter.

3. The lighting device of claim 2, wherein:

the first light emitter is a display and the first light is an image, and the second light emitter is a general illumination light source and the second light is an illumination light.

4. The lighting device of claim 3, wherein the image is one of a stationary image or a moving image.

5. The lighting device of claim 3 wherein the flicker is an interference in frequency between the first light emitter and the second light emitter.

6. The lighting device of claim 5, wherein the function to control the flicker is to mitigate the flicker.

7. The lighting device of claim 6, wherein, to mitigate the flicker, the processing system is configured to synchronize a first frequency of an image output waveform of the image light outputted from display with a second frequency of a light output waveform of the illumination light outputted from the general illumination light source resulting in a controlled output frequency of the combined light.

8. The lighting device of claim 7, wherein the processing system comprises an internal clock and is configured to synchronize the first and the second frequencies by coordinating timing of the driver system associated with the display with timing of the driver system associated with the general illumination light source.

9. The lighting device of claim 7, further comprising:

a reference clock; and a phase locked loop (PLL) coupled to the reference clock, wherein:

the reference clock and the PLL are embedded in the luminaire, and the PLL is configured to synchronize the first and the second frequencies by locking the phase of the image output waveform to the phase of the light output waveform.

10. The lighting device of claim 6, wherein to mitigate the flicker, the processing system is further configured to instruct the driver system to apply a first modulation scheme to one of the image light outputted from the display or the illumination light outputted from the general illumination light source.

11. The lighting device of claim 10, wherein to apply the first modulation scheme, the driver system is configured to modulate outputs of pixel light sources of one of the first light emission matrix of the display or the second light emission matrix of the general illumination light source in accordance with the first modulation scheme.

12. The lighting device of claim 11, wherein the first modulation scheme is a continuous wave modulation comprising a direct current (DC) modulation.

13. The lighting device of claim 12, wherein the DC modulation is applied to the light output from the first emitter such that output frequency of the combined light is same as the second frequency.

14. The lighting device of claim 12, wherein the DC modulation is applied to the light output from the second emitter such that the output frequency of the combined light is same as the first frequency.

15. The lighting device of claim 5, wherein the function to control the flicker is to modify the flicker.

16. The lighting device of claim 15, wherein the processing system is further configured to instruct the driver system to apply a second modulation scheme to modify the flicker.

17. The lighting device of claim 16, wherein the second modulation scheme is a pulse modulation comprising one of a frequency shift modulation or an amplitude shift modulation.

18. The lighting device of claim 17, wherein to apply the frequency shift modulation, the driver system is further configured to modify frequency of operation of pixel light sources of the first light emission matrix of the display.

19. The lighting device of claim 18, wherein to apply the frequency shift modulation, the driver system is further configured to modify frequency of operation of pixel light sources of the second light emission matrix of the general illumination light source.

20. The lighting device of claim 17, wherein to apply the amplitude shift modulation, the driver system is further configured to modify amplitude of pixel light sources of the second light emission matrix of the light source resulting in a modified amplitude of the combined output signal.

21. The lighting device of claim 17, wherein to apply the amplitude shift modulation, the driver system is further configured to modify amplitude of pixel light sources of the first light emission matrix of the display.

22. A method comprising:

operating a first light emission matrix to output light of an image via an output of a first light emitter;

operating a second light emission matrix to output illumination light via an output of a second light emitter;

during the operations of the first and light emission matrices, outputting a combined light; and controlling the output of at least one of the light of the image or the illumination light to control flicker due to interaction of a portion of the light from the first light emitter and a portion of the illumination light from the second light emitter.

23. The method of claim 22, wherein the flicker is an interference in frequency between the first light emitter and the second light emitter.

24. The method of claim 22, wherein the controlling the output comprises synchronizing the frequency of the output of the image light with the output of the illumination light.

25. The method of claim 22, wherein the controlling the output comprises applying a direct current (DC) modulation to the output of the image light.

26. The method of claim 22, wherein the controlling the output comprises applying a direct current (DC) modulation to the output of the illumination light.

27. The method of claim 22, wherein the controlling the output comprises applying a frequency shift modulation to the output of the image light.

28. The method of claim 22, wherein the controlling the output comprises applying a frequency shift modulation to the output of the illumination light.

29. The method of claim 22, wherein the controlling the output comprises applying an amplitude shift modulation to the output of the image light.

30. The method of claim 22, wherein controlling the output comprises applying an amplitude shift modulation to the output of the illumination light.

* * * * *